US005252969A

United States Patent [19]

Kishi

[11] Patent Number: 5,252,969

[45] Date of Patent: Oct. 12, 1993

[54] TEMPORARY SIGNAL SYSTEM

[75] Inventor: Mitsuhiro Kishi, Tochigi, Japan

[73] Assignee: Japanic Corporation, Ashikaga, Japan

[21] Appl. No.: 717,100

[22] Filed: Jun. 18, 1991

[30] Foreign Application Priority Data

Jun. 21, 1990 [JP] Japan ..... 2-163085
Jun. 21, 1990 [JP] Japan ..... 2-163086

[51] Int. Cl.[5] ..... G08G 1/095

[52] U.S. Cl. ..... 340/908; 340/908.1; 340/907; 340/926; 340/825.69; 340/309.15

[58] Field of Search ..... 340/908, 908.1, 907, 340/926, 825.69, 825.72, 309.15, 958; 364/436

[56] References Cited

U.S. PATENT DOCUMENTS

| | | | |
|---|---|---|---|
| 2,829,362 | 4/1958 | Terrill | 340/908 |
| 3,046,521 | 7/1962 | Cantwell et al. | 340/908 |
| 4,032,883 | 6/1977 | Gibson | 340/908 |
| 4,857,921 | 8/1989 | McBride et al. | 340/908 |
| 4,916,621 | 4/1990 | Bean et al. | 340/908 |

*Primary Examiner*—Donnie L. Crosland
*Attorney, Agent, or Firm*—Flynn, Thiel, Boutell & Tanis

[57] ABSTRACT

A temporary signal system wherein a pair of signal stands are installed at spaced locations adjacent a traffic restriction area. Each stand has at least red and green lights which light or flash for predetermined time periods to control vehicle traffic passing the restriction area. The signal stands include timers for counting actual time and providing the actual time, controllers for producing a flashing control signal for a selected red or green light upon reception of a time signal provided by the timer when the controller is in a flashing operation condition, and a lighting driver for permitting the selected red or green light to flash upon reception of the flashing control signal from the controller. The stands have an operation starting arrangement for initiating operation of the controllers of both of the stands at the same time, or a signal transmission arrangement for transmitting the operating condition data between the stands so that the lights of both stands are operated in a controlled and synchronized relationship with each other.

19 Claims, 29 Drawing Sheets 1e
70
71
72
57
DRIVE CIRCUIT
5
R
6
G
33
SSR
34
SSR
32
SIGNAL FORMING CIRCUIT
36
D/C POWER SOURCE
11
AC100V
30
INTERFACE CIRCUIT
29
BPF
28
AM RECEIVER
31
26
CONTROLLER
TIMER
27
25
10
9
12
16

81
80
TRANSMITTER
1g
5
R
6
G
33
SSR
34
SSR
32
SIGNAL FORMING CIRCUIT
36
D/C POWER SOURCE
11
AC100V
30
INTERFACE CIRCUIT
29
BPF
31
28
AM RECEIVER
26
CONTROLLER
TIMER
27
25
19
16
10
9
12

TEMPORARY SIGNAL SYSTEM

BACKGROUND OF THE INVENTION

1. Field of the Invention

The present invention relates to a temporary signal system employed at a road construction site, a building site, a traffic accident site or the like, and in particular to a temporary signal system capable of eliminating cable between at least two signal lights while provided synchronizing flashing operations thereof.

2. Prior Art

A temporary signal system of this type is often employed in situations where vehicles are restricted to enter or leave a road construction site, a road repair site, a construction site, or a traffic restriction area where one or more traffic lanes is restricted so that at least two signal stands are temporarily installed at the entrance and exit of such restriction area.

Such a temporary signal system can be temporarily employed at a construction site such as when paving a road whereby vehicles passing the construction site are restricted. Accordingly, it is possible to eliminate a watchman and safely proceed with the construction.

SUMMARY OF THE INVENTION

It is an object of a first aspect of the present invention to provide a temporary signal system capable of operating both parent and child signal stands by operation starting means which synchronize the flashing operations between the parent and child signal stands.

It is another object of the first aspect of the present invention to provide a temporary signal system capable of eliminating the signal cable which typically connects the parent and child signal stands together.

It is an object of the second aspect of the present invention to provide a temporary signal system capable of operating both the parent and child signal stands by the transmission of setting and synchronizing data from the parent signal stand to the child signal stand to thereby conform actual time in a timer of the parent signal stand to that of the chid signal stand for synchronizing the flashing operations between the parent and child signal stands.

The temporary signal system according to the first aspect of the present invention comprises signal stands installed in at least two locations in a traffic restriction area and having at least red and green (or blue) lights which flash for a predetermined period so as to control and restrict the vehicles passing the traffic restriction area. The signal stand is composed of a timer for counting actual time and providing the actual time, a controller for producing a flashing control signal upon reception of the actual time provided by the timer and a flashing operation condition, a lighting driving means for permitting the red and green lights to flash upon reception of the flashing control signal, and an operation starting means for actuating the controllers of both stands at the same time.

The operation starting means for starting the operations of both the signal stands at the same time comprises a push button provided at each signal stand, or means utilizing radio waves provided at each signal stand, or means utilizing light provided at each signal stand, or means utilizing sound waves provided at each signal stand.

The temporary signal system according to the second aspect of the present invention comprises signal stands installed in at least two locations in a traffic restriction area and having at least red and green (or blue) lights which flash for a predetermined period so as to control and restrict the vehicles passing the traffic restriction area. The signal stand is composed of a timer for counting actual time and providing the actual time, a memory for storing data for setting the flashing operation condition and data for synchronization, a controller for producing a flashing control signal upon reception of the actual time provided by the timer and the operation condition data and the synchronous data, a lighting driving means for permitting the red and green lights to flash upon reception of the flashing control signal, and a signal transmission means interposed between the signal stands for transmitting the operation condition data and the synchronous data stored in the memory of one signal stand to the memory of the other signal stand so that both the lights are synchronous with each other.

The above and other objects, features and advantages of the present invention will become more apparent from the following description taken in conjunction with the accompanying drawings.

DETAILED DESCRIPTION

First Embodiment (FIGS. 1 to 6)

Figure 1:
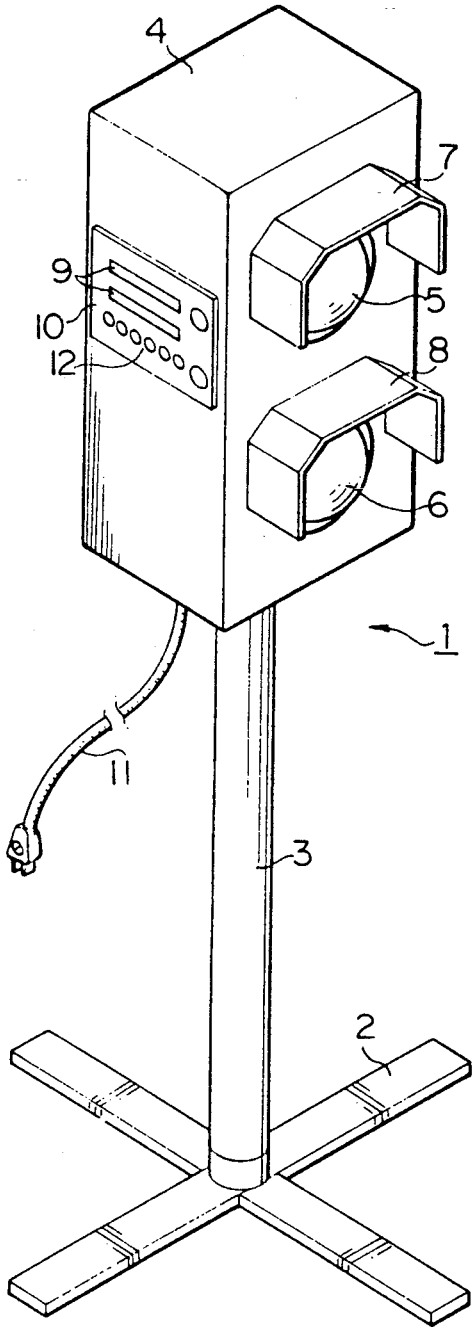
FIG. 1 is a perspective view showing a signal stand of a temporary signal system according to a first embodiment of the present invention.

A temporary signal system according to a first embodiment of the invention will be described with reference to FIGS. 1 to 6.

A signal stand 1 comprises a cross-shaped base or stand 2, a leg 3 protruding vertically from the center of the leg base 2, and a body 4 housing an electronic circuit and the like. The body 4 has a red light 5 and a green (or blue) light 6 provided at upper and lower portions of one side thereof and covers 7 and 8 for covering the red and green lights 5 and 6. The red and green lights employed in the present invention are different from those employed in the ordinary traffic lights. That is, the former flashes while the latter lights steady. The body 4 also has an operation board or panel 10 having an indication portion 9 at the side thereof. A power source cable 11 is extended from the body 4 for connecting the body 4 to a commercial power source, a battery or the like. The temporary signal system according to the present invention has at least two signal stands.

Figure 2:
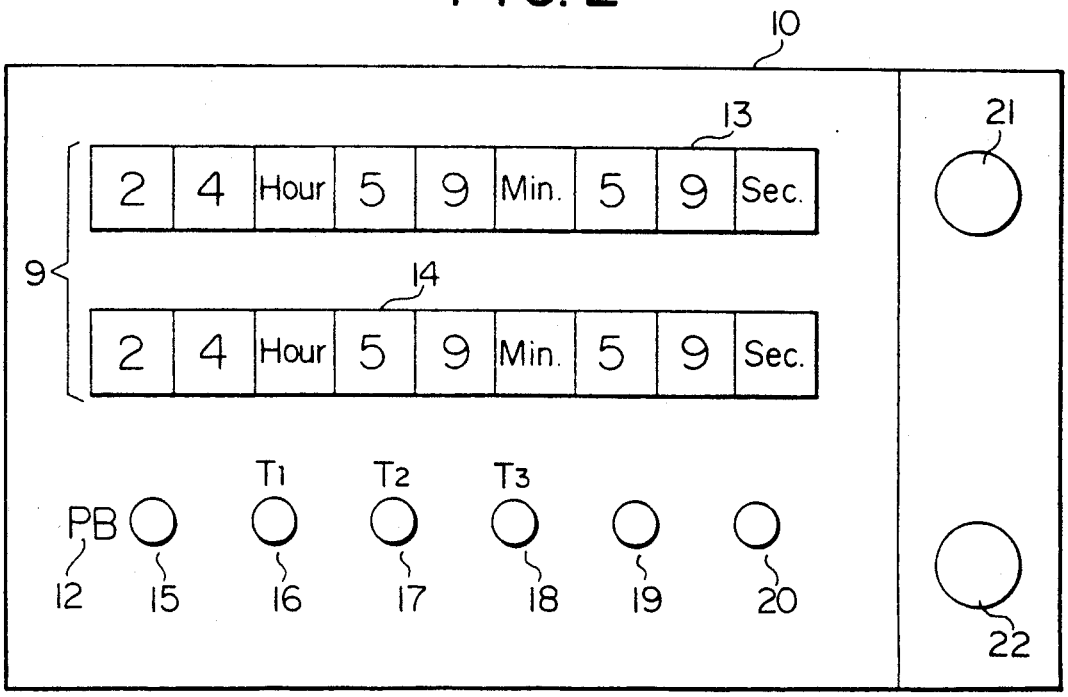
FIG. 2 is a front view showing an operation board or panel of the signal stand in FIG. 1.

In FIG. 2, the operation board 10 comprises the indication portion 9 and an operation portion 12. The indication portion 9 has an indication panel 13 for indicating actual time at the upper portion thereof and a setting panel 14 for indicating a setting value at the lower portion thereof. The operation portion 12 comprises push buttons 15 to 20 and mode selection switches 21 and 22. The push buttons 15 to 20 function to set or operate as follows, as described in connection with FIG. 4. The push button 15 sets a present time and the push button 16 sets a flashing (i.e. energizing) time $T_1$ of the green light 6 of a first signal stand 1 serving as a parent stand, the push button 17 sets a flashing (i.e. energizing) time $T_2$ of the green light 6 of a second signal stand serving as a child stand, and the push button 18 sets an overlap time $T_3$ of energizing the red lights of both the parent and child stands. The push (or start) button 19 sets a start of the flashing operation while the push button 20 sets a completion of the flashing operation. The mode selection switch 21 selects an operating mode or a setting mode, while the mode selection switch 22 selects a normal operating mode or a red light flashing operation mode.

Figure 3:
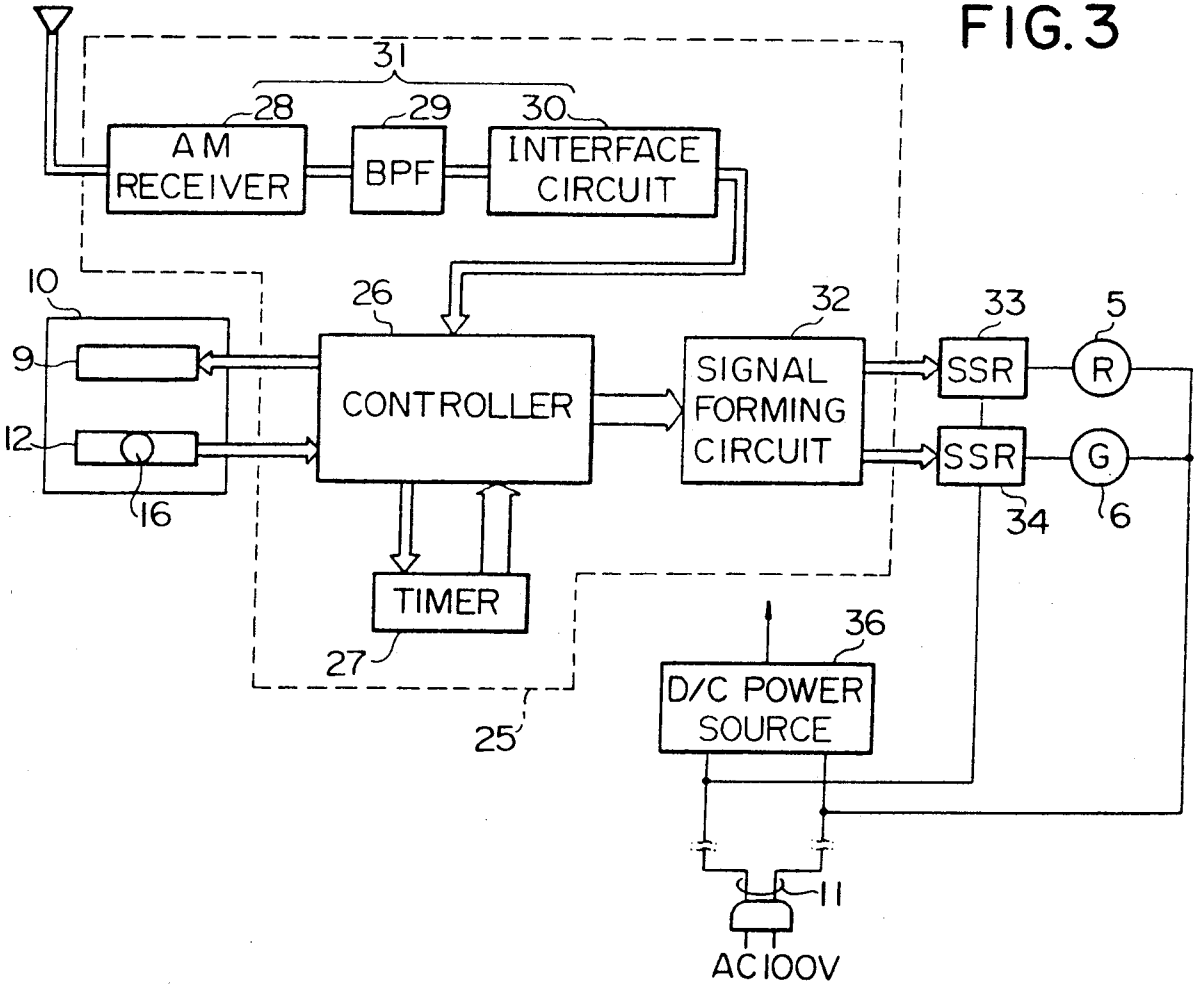
FIG. 3 is a circuit diagram of the signal stand of FIG. 1.

FIG. 3 is a circuit diagram of the signal stand 1 according to the first embodiment of the present invention.

The control portion 25 comprises a controller 26 composed of, e.g. an 8 bit microcomputer, a timer 27 controlled by the controller 26 for supplying the present time to the controller 26, a time correction circuit 31 composed of an amplitude modulation (AM) receiver 28, a band path filter (BPF) 29 for extracting a time tone received by the AM receiver 28 and an interface circuit 30 for rectifying a wave of the thus extracted signal and producing a time correction signal which is supplied to the controller 26, and a signal forming circuit 32 for producing a triggering signal upon reception of a flashing control signal supplied by the controller 26.

The controller 26 is connected to the indication portion 9 and operation portion 12 of the operation board 10 while the signal forming circuit 32 is connected to switching elements 33 and 34 respectively composed of, e.g solid-state relays (SSRs) and the like. The switching elements 33 and 34 flash the red and green lights 5 and 6 respectively connected to the commercial power source upon reception of the triggering signal from the signal forming circuit 32. Lighting driving means comprises the signal forming circuit 32 and the switching elements 33 and 34. Denoted at 36 is a direct current power source for rectifying the power voltage and supplying the direct current power for driving each circuit.

Figure 4:
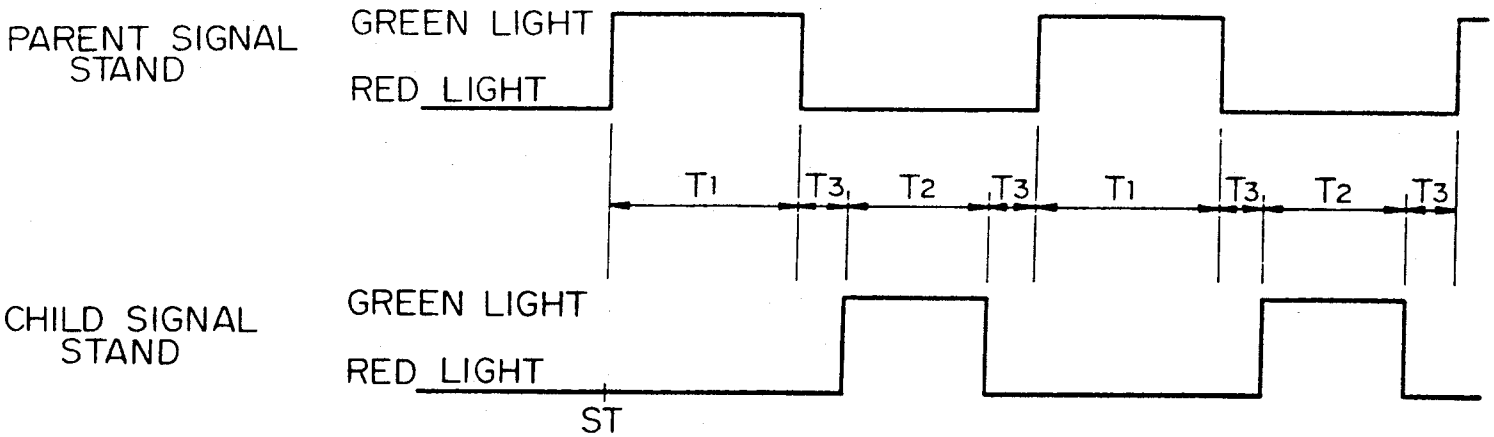
FIG. 4 is a timing chart showing operation of the temporary signal system according to first to sixth embodiments of the invention.

An operation of the temporary signal system having an arrangement set forth above will be described with reference to FIGS. 4 to 6.

Initialization

It is necessary to initialize the flashing condition for determining the operations of the signal stands 1*a* and 1*b* having the same arrangement.

The two signal stands 1*a* and 1*b* are positioned at one spot so as to be close to each other whereby a flashing condition for the red and green lights 5 and 6 is set to an appropriate value. This is done by operations of the mode selection switches 21 and the push buttons 16 to 18 of both stands. That is, the mode selection switch 21 selects the setting mode while the bush buttons 16 to 18 set the flashing or energized time $T_1$ of the green light 6 of the parent stand 1*a*, the flashing or energized time $T_2$ of the green light 6 of the child stand 1*b*, and an overlap time $T_3$ of both red lights 5 of the parent and child signal stands 1*a* and 1*b*. Likewise, the push buttons 15 are operated to set the present (i.e. actual) time on both the parent and child stands 1*a* and 1*b*. The flashing times $T_1$ to $T_3$ are set to an optimum or desired value judging from the road condition such as traffic restriction, restricting distance, and travel volume at day and night.

Installation of Signal Stands

The signal stands are installed in the area where the traffic restriction exists after completion of the initialization.

For example, the parent signal stand 1*a* is installed at one end 42*a* of the paving construction interval 41 while the child signal stand 1*b* is installed at the other end 42*a* thereof. The power source cables 11 of the signal stands 1*a* and 1*b* are inserted into appropriate power supplies.

Starting Operation of the Signal Stands

After completion of the installation of the signal stands, both signal stands 1*a* and 1*b* are operated. At the time of starting of operation, operators standing at both signal stands simultaneously push the start buttons 19 after confirming signals between both operators such as by calling each other or signalling by hand flags or the like.

In such manner, both signal stands 1*a* and 1*b* are operated in accordance with the predetermined initial values.

Figure 6A:
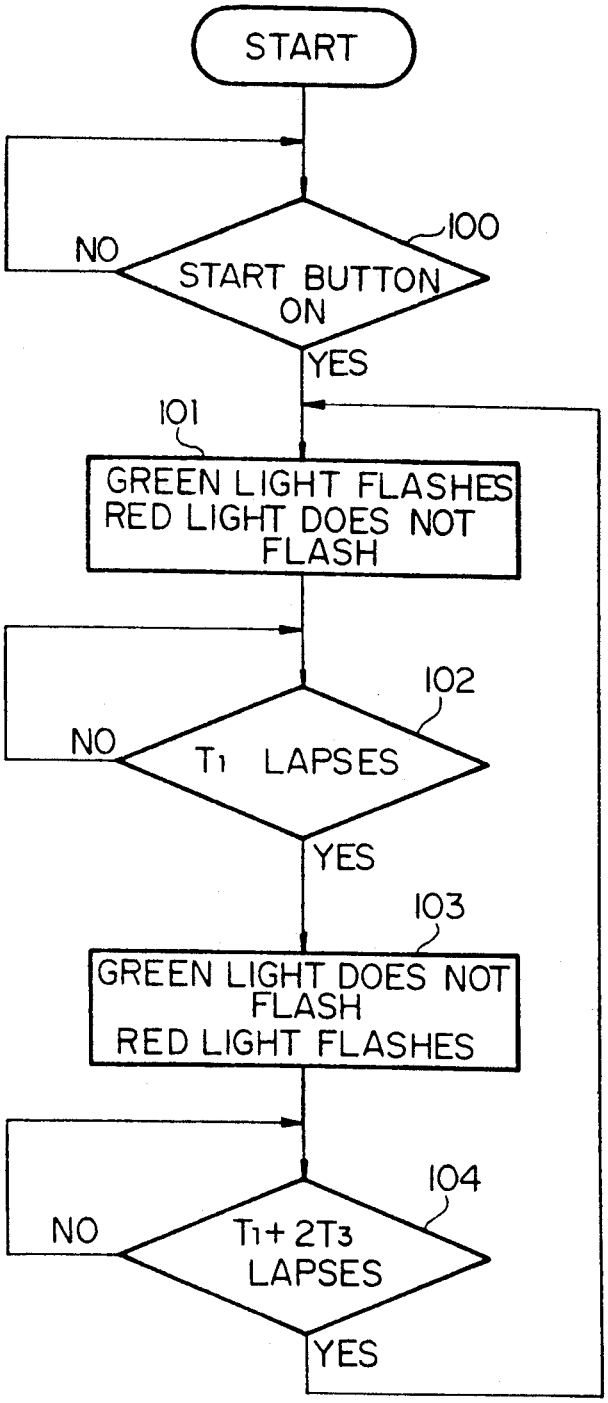
FIGS. 6(*a*) and (*b*) are flow charts showing procedures of operation of the temporary signal system according to the first to sixth embodiments of the invention.
Figure 6B:
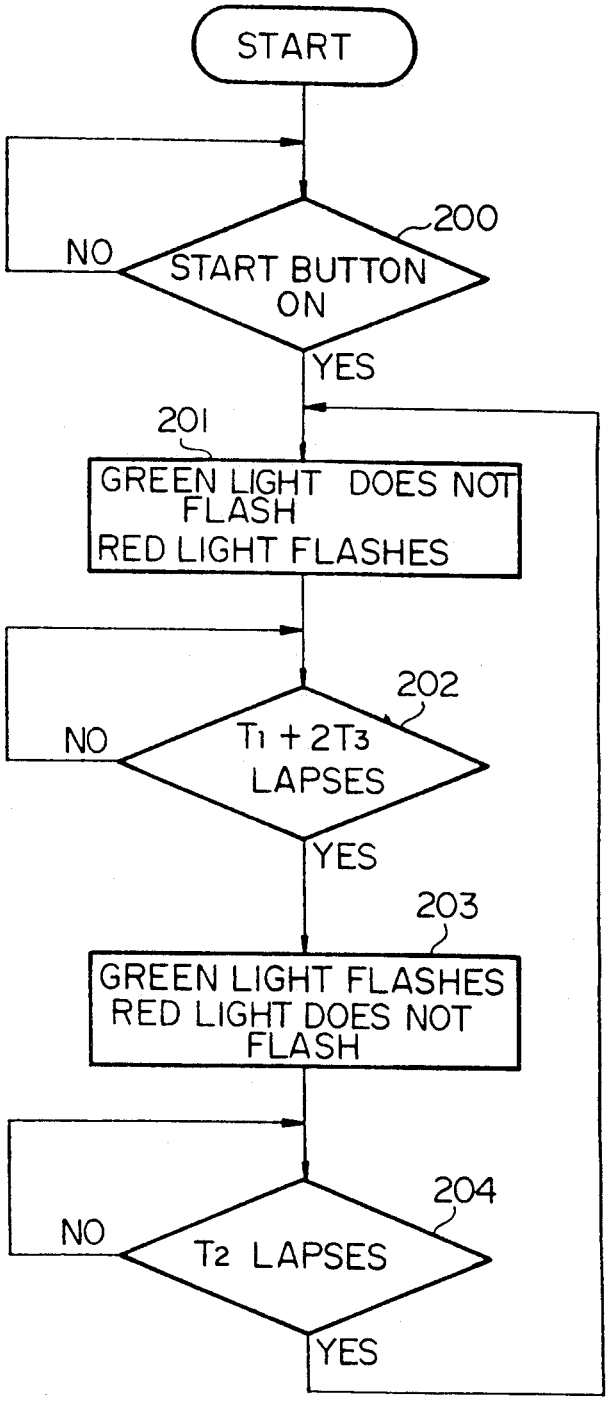

The parent signal stand 1*a* operates in accordance with the flow chart illustrated in FIG. 6(*a*) while the child signal stand 1*b* operates in accordance with the flow chart illustrated in FIG. 6(*b*).

That is, the parent signal stand 1*a* operates as follows and as illustrated in FIG. 6(*a*).

The controller 26 watches as to whether the start button 19 is pressed (Step 100). If the start button 19 is pressed, the controller 26 operates the signal forming circuit 32, thereby switching the switching element 34 so that the green light 6 flashes (Step 101) and waits until the time $T_1$ lapses (Step 102). When the time $T_1$ lapses, the controller 26 operates the signal forming circuit 32, thereby switching the switching element 33 so that the red light 5 flashes (Step 103) and waits until the time $T_2+2T_3$ lapses (Step 104). When the time $T_2+2T_3$ lapses (Step 104), the process returns to the step 101 and is repeated.

On the contrary, the child signal stand 1*b* operates as follows and as illustrated in FIG. 6(*b*).

The controller 26 watches as to whether the start button 19 is pressed (Step 200). If the start button 19 is pressed, the controller 26 immediately operates the signal forming circuit 32, thereby switching the switching element 33 so that the red light 5 flashes (Step 201) and waits until the time $T_1+2T_3$ (at first time, the time $T_1+T_3$) lapses (Step 202). If the time $T_1+2T_3$ (at first time, the time $T_2+T_3$) lapses, the controller 26 operates the signal forming circuit 32, thereby switching the switching element 34 so that the green light 6 flashes (Step 203) and waits until the time $T_2$ lapses (Step 204). When the time $T_2$ lapses (Step 204), the process returns to the Step 201 and is repeated.

Inasmuch as the flashing times $T_1$ to $T_3$ are determined on the basis of the actual time supplied by the timer 27, there occurs a slight delay. However, inasmuch as the time correction circuit 31 supplies a correction signal to the controller 26 every hour to correct the time, there does not occur the case where the red and green lights 5 and 6 of the parent signal stand 1*a* flash in a non-synchronized way from those of the child signal stand 1*b*.

At the time of starting the operation of the parent and child signal stands, although the start buttons 19 are pressed after the parent and child signal stands 1*a* and 1*b* are placed at the remote positions, the start buttons 19 may be pressed in the following way.

After the completion of the setting operation of the times $T_1$ to $T_3$, one operator brings the parent signal stand 1*a* to the child signal stand 1*b* or vice versa and pushes the two start buttons 19 at the same time to synchronize the flashing operations of the red and green lights in both the signal stands 1*a* and 1*b*. Thereafter, the parent signal stand 1*a* is carried to one end 42*a* of the construction zone 41 while the child stand 1*b* is carried to the other end 42*b* of the construction zone 41. In this case, the controller 26 is alone standby for operation and the power source cable 11 is connected to the commercial power source at the installation locations 42*a* and 42*b*, thereby controlling flashing of the red and green lights 5 and 6.

According to the present invention, since the starting operation of the signal stands 1*a* and 1*b* is effected manually and the synchronization of flashing between the red and green lights 5 and 6 is based on the actual timer 27 and the time correction circuit 31 for correcting the time supplied by the timer 27, a signal cable for connecting both the parent and child signal stands together to synchronize the operation thereof is unnecessary, which is thus very convenient.

Figure 7A:
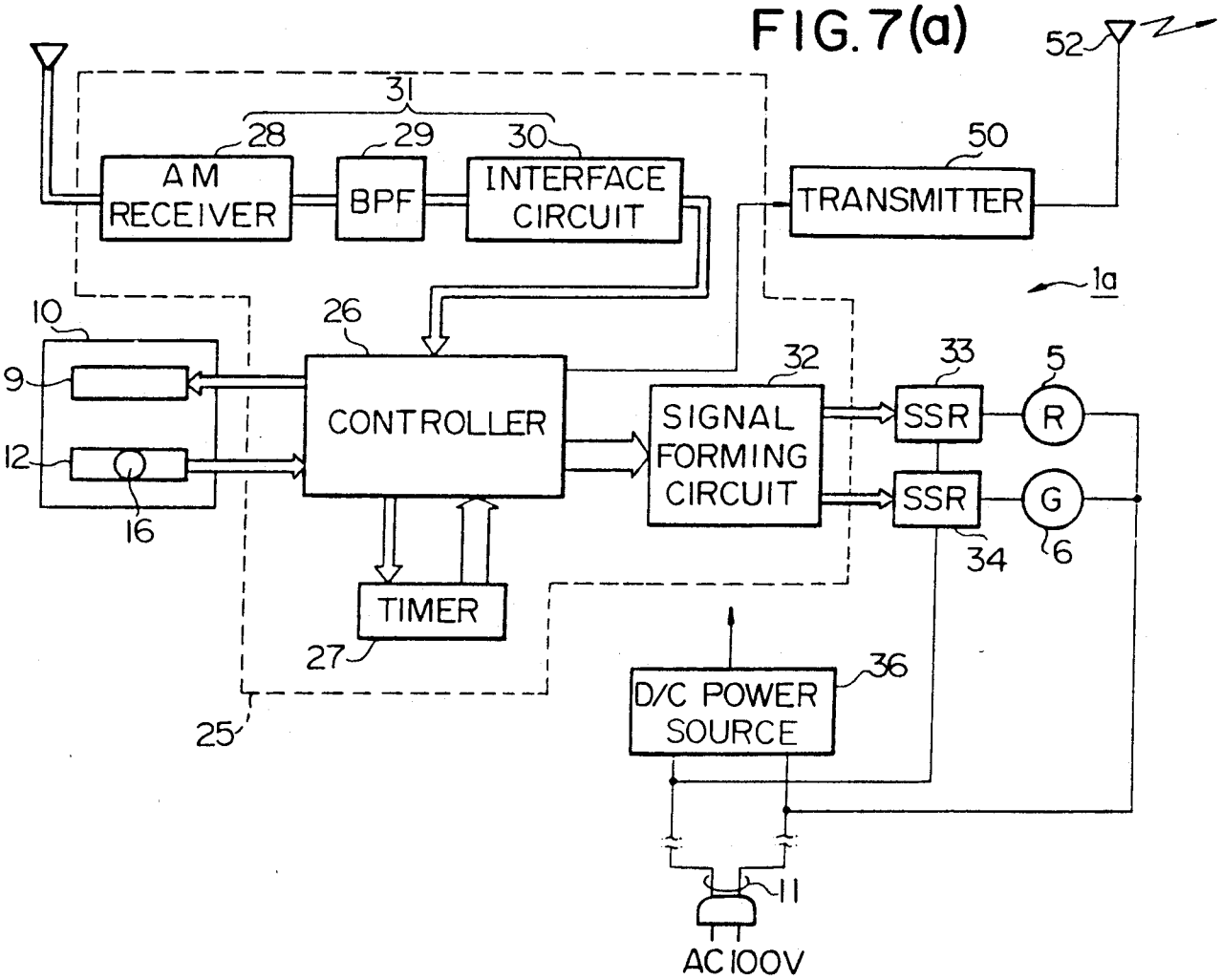
FIG. 7(*a*) is a circuit diagram of a parent signal stand and FIG. 7(*b*) is a circuit diagram of a child signal stand respectively of a temporary signal system according to a second embodiment of the invention.
Figure 7B:
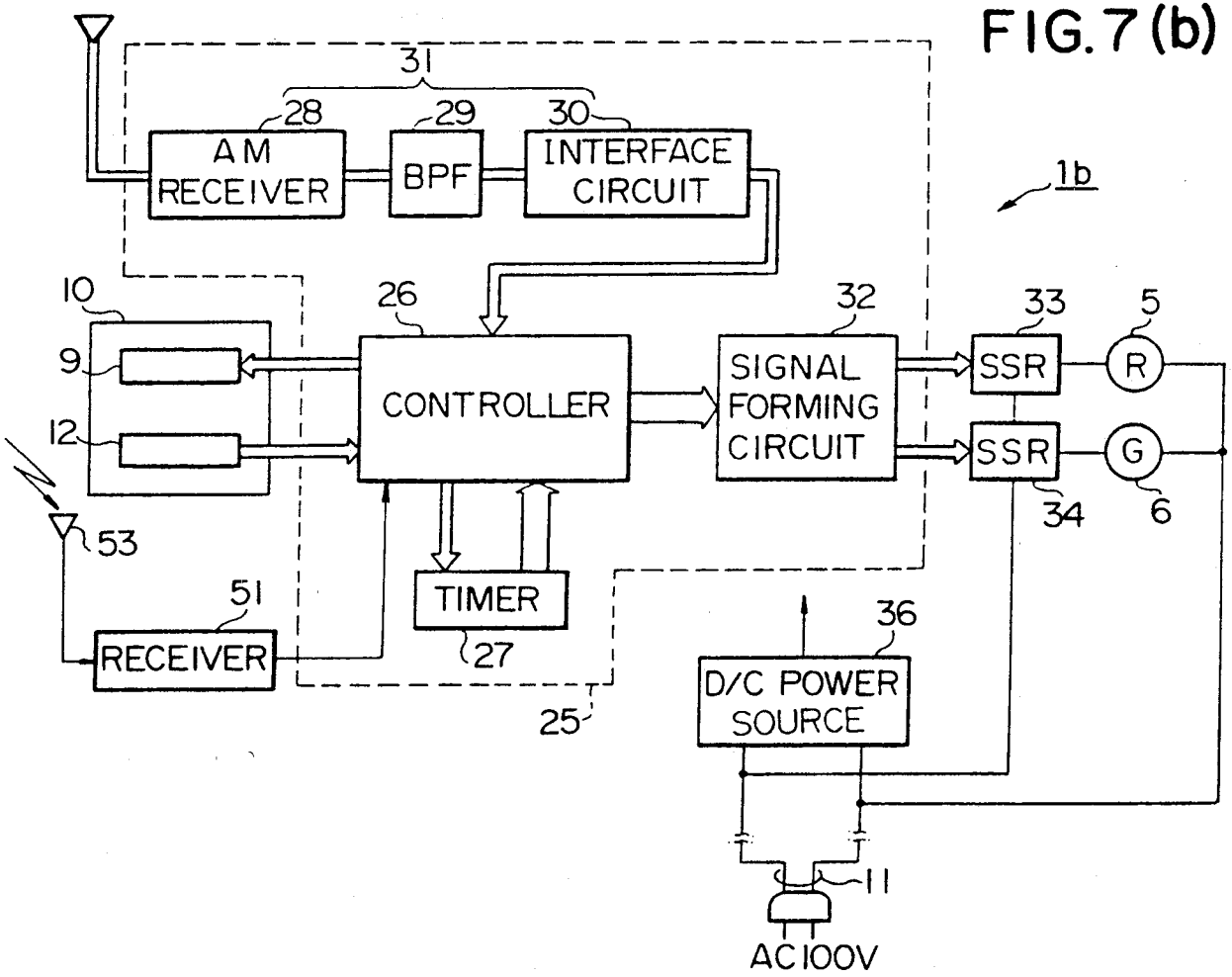

Second Embodiment (FIG. 7(*a*) (*b*))

A temporary signal system according to a second embodiment will be described with reference to FIGS. 7(*a*) and 7(*b*) in which FIG. 7(*a*) shows a circuit diagram of the parent signal stand 1*a* and FIG. 7(*b*) shows a circuit diagram of the child signal stand 1*b*.

In the embodiment illustrated in FIGS. 7(*a*) and 7(*b*), the parent and child signal stands 1*a* and 1*b* employ a wireless arrangement as operation starting means.

That is, the parent signal stand 1*a* has a transmitter 50 for transmitting a radio wave of specific frequency by way of an antenna 52 when the start button 19 is pressed as illustrated in FIG. 7(*a*). The child signal stand 1*b* has a receiver 51 for receiving the radio wave transmitted by the transmitter 50 by way of an antenna 53 for operating the respective controller 26.

The arrangement of the temporary signal system of the second embodiment is the same as that of the first embodiment excepting the transmitter 50 and the receiver 51.

An operation of the temporary signal system according to the second embodiment will be described hereinafter.

Figure 5:
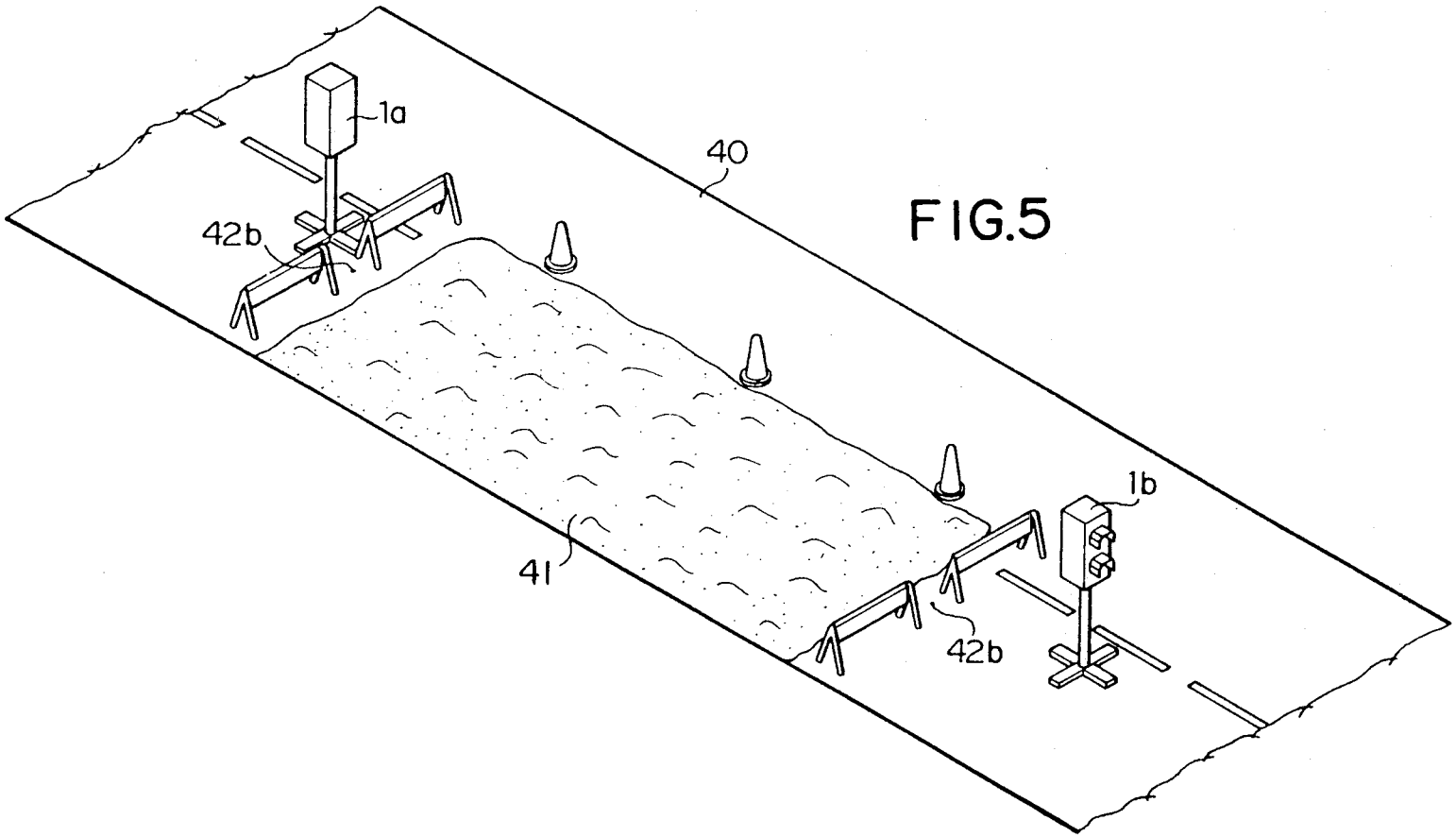
FIG. 5 is a perspective view showing the employment of the temporary signal system at a construction site according to the first to sixth embodiments of the invention.

The parent and child signal stands 1*a* and 1*b* are installed at opposite ends 42*a* and 42*b* of the construction site 41 in the same way as illustrated in FIG. 5.

If the start button 19 in the parent signal stand 1*a* is pressed by the operator, the controller 26 starts its operation to drive the transmitter 50 so that the transmitter 50 transmits the radio wave for a given time period. Whereupon the receiver 51 in the child stand 1*b* receives the radio wave signal, thereby operating the controller 26 of stand 1*b*. Consequently, both the parent and child signal stands 1*a* and 1*b* are synchronized with each other.

Inasmuch as the child signal stand 1*b* starts its operation upon reception of the radio wave signal transmitted by the parent signal stand 1*a*, the child signal stand 1*b* can be operated without any deviation in its synchronization with the parent signal stand 1*a*.

The other advantages and functions of the temporary signal system according to the second embodiment are the same as those of the first embodiment.

Figure 8A:
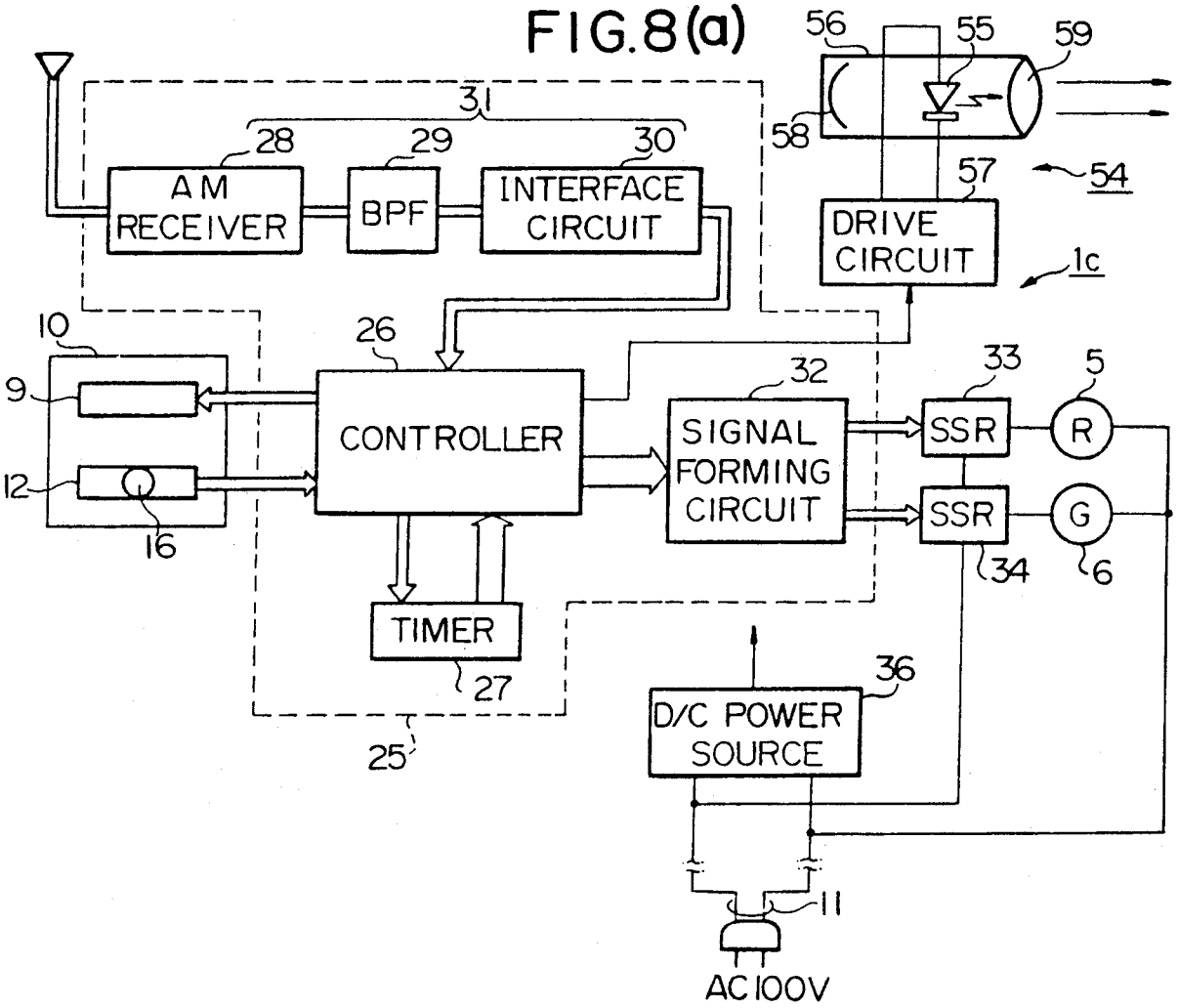
FIG. 8(*a*) is a circuit diagram of a parent signal stand and FIG. 8(*b*) is a circuit diagram of a child signal stand respectively of a temporary signal system according to a third embodiment of the invention.
Figure 8B:
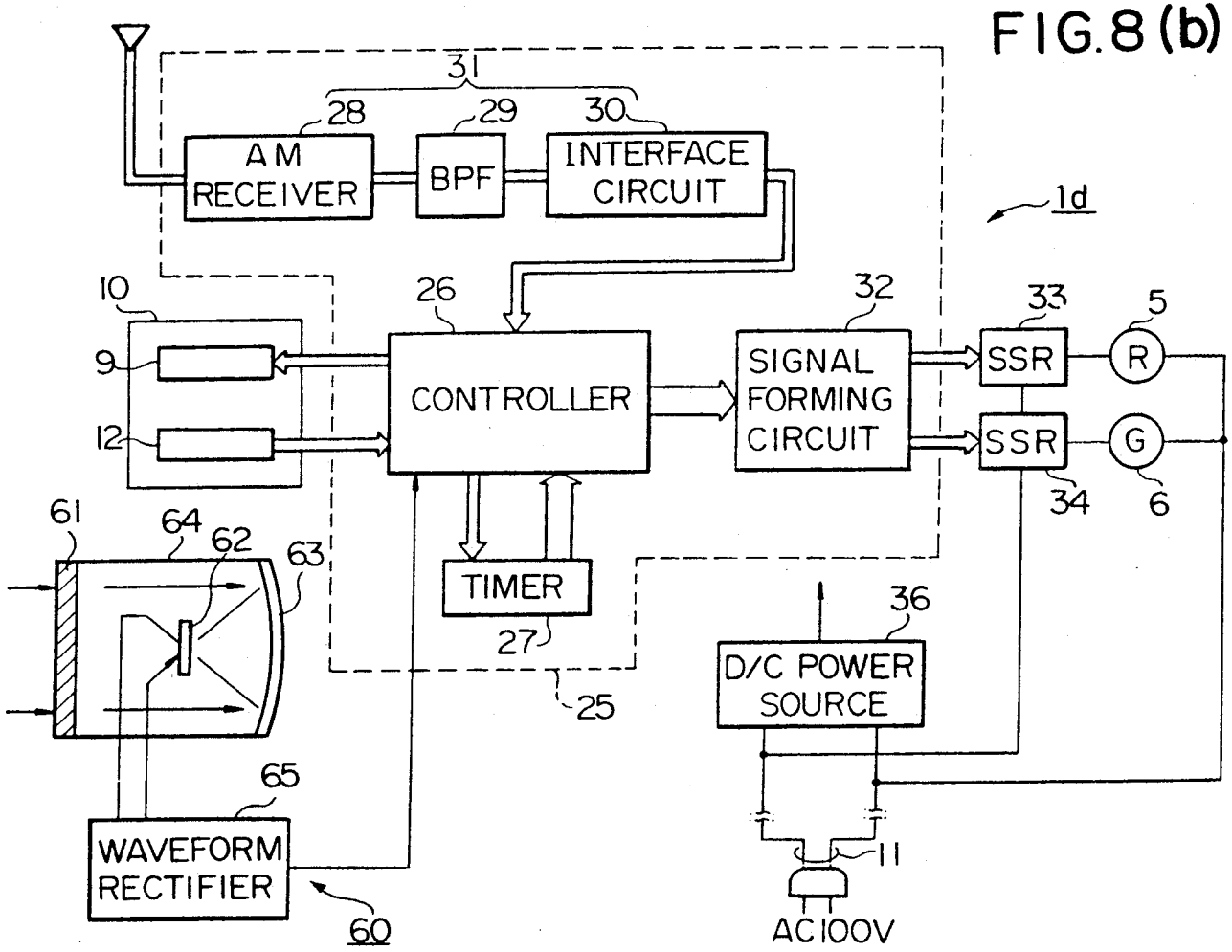

Third Embodiment (FIGS. 8(*a*) and 8(*b*))

A temporary signal system according to a third embodiment will be described with reference to FIGS. 8(*a*) and 8(*b*) in which FIG. 8(*a*) shows a circuit diagram of the parent signal stand 1*c* and FIG. 8(*b*) shows a circuit diagram of the child signal stand 1*d*.

In the third embodiment as illustrated in FIGS. 8(*a*) and 8(*b*), the parent and child signal stands 1*c* and 1*d* employ a light signal such as a laser light or the like . as operation starting means.

That is, the parent signal stand 1c has a light emitting means 54 capable of emitting an infrared laser beam when the start button 19 is pressed as illustrated in FIG. 8(*a*). The light emitting means 54 comprises a light emitter 56 including an infrared laser beam emitting device 55 for emitting the infrared laser beam and a drive circuit 57 for turning the infrared laser beam emitting device 55 on or off. The light emitter 56 includes a reflector 58 provided at one end of the beam emitting device 55 and a lens 59 for focusing the laser beam provided at the other end of the light emitting device 55.

The child signal stand 1d has a light receiving means 60 for receiving the infrared laser beam and converting the infrared laser beam to an electric signal for operating the controller 26.

The light receiving means 60 comprising an infrared ray filter 61 at the front thereof, an optical system 64 inside thereof composed of a light receiving device 62 and a reflector 63 for focusing the infrared laser beam on the light receiving device 62, and a wave forming circuit 65 for forming a signal to drive the controller 26 of stand 1d.

The arrangement of the temporary signal system of the third embodiment is the same as that of the first embodiment excepting the light emitting means 54 and the light receiving means 60.

An operation of the temporary signal system according to the third embodiment will be described hereinafter.

The parent and child signal stands 1c and 1d are installed at opposite ends 42a and 42b of the construction site 41 in the same way as illustrated in FIG. 5.

In the parent signal stand 1c, if the start button 19 is pressed by the operator, the controller 26 starts its operation to drive the light emitting means 54 so that the light emitter 56 emits a laser beam signal for a given period. Whereupon the light receiving means 60 in the child stand 1b receives the laser beam signal. The thus received laser beam signal is detected by the light receiving element 62 and rectified by the wave rectifier 65 which is supplied to the controller 26. As a result, the controller 26 of the child signal stand 1d starts its operation. Both the parent and child signal stands 1c and 1d operate in the processes as illustrated in the flow charts of FIGS. 6(*a*) and 6(*b*).

Inasmuch as the child signal stand 1d starts its operation upon reception of the laser beam emitted by the parent signal stand 1c, there occurs deviation of the synchronization of flashing operations of the red and green lights between the parent and child signal stands 1c and 1d.

Although the laser beam has been employed in the third embodiment, an ordinary light signal can be employed.

Figure 9A:
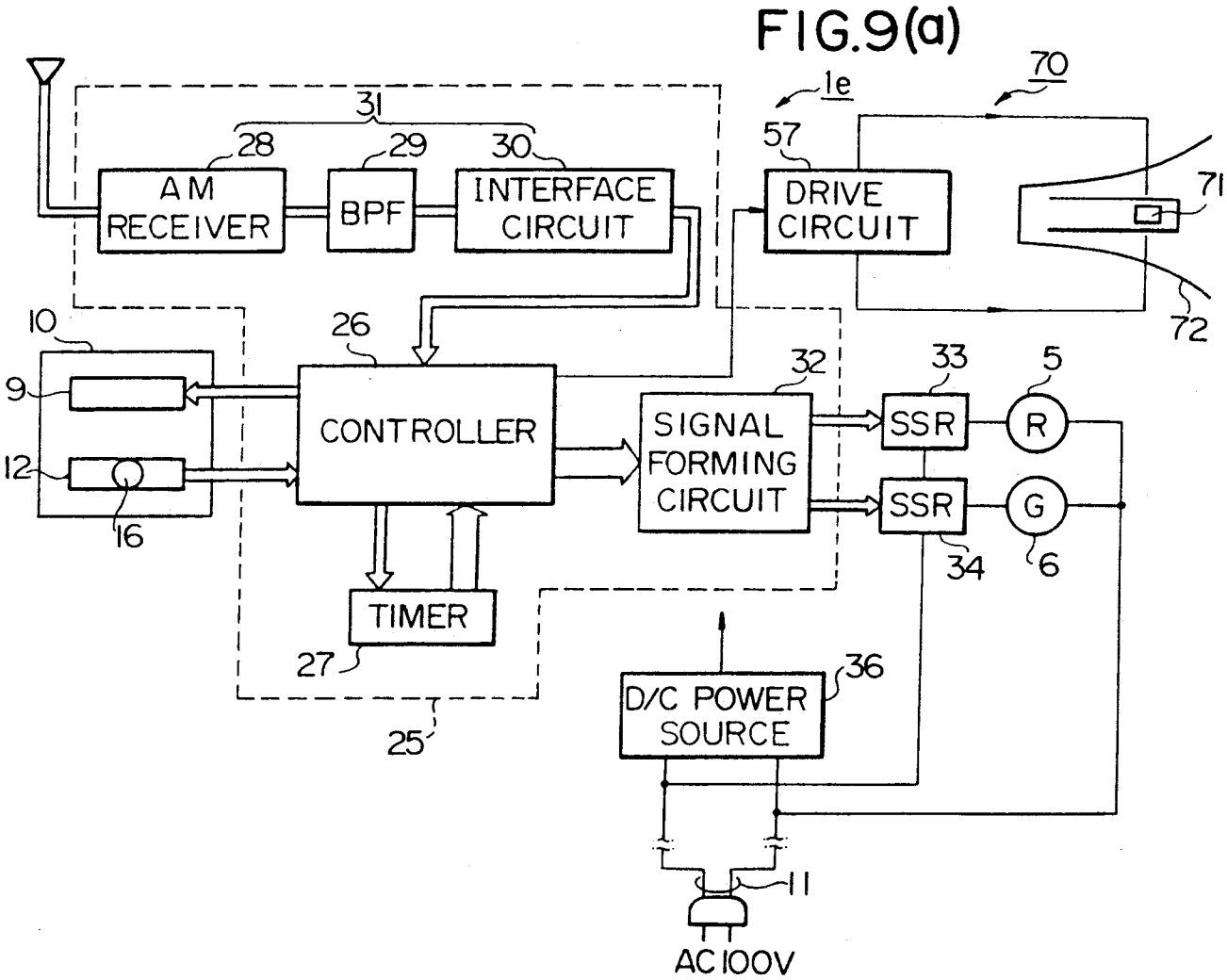
FIG. 9(*a*) is a circuit diagram of a parent signal stand and FIG. 9(*b*) is a circuit diagram of a child signal stand respectively of a temporary signal system according to a fourth embodiment of the invention.
Figure 9B:
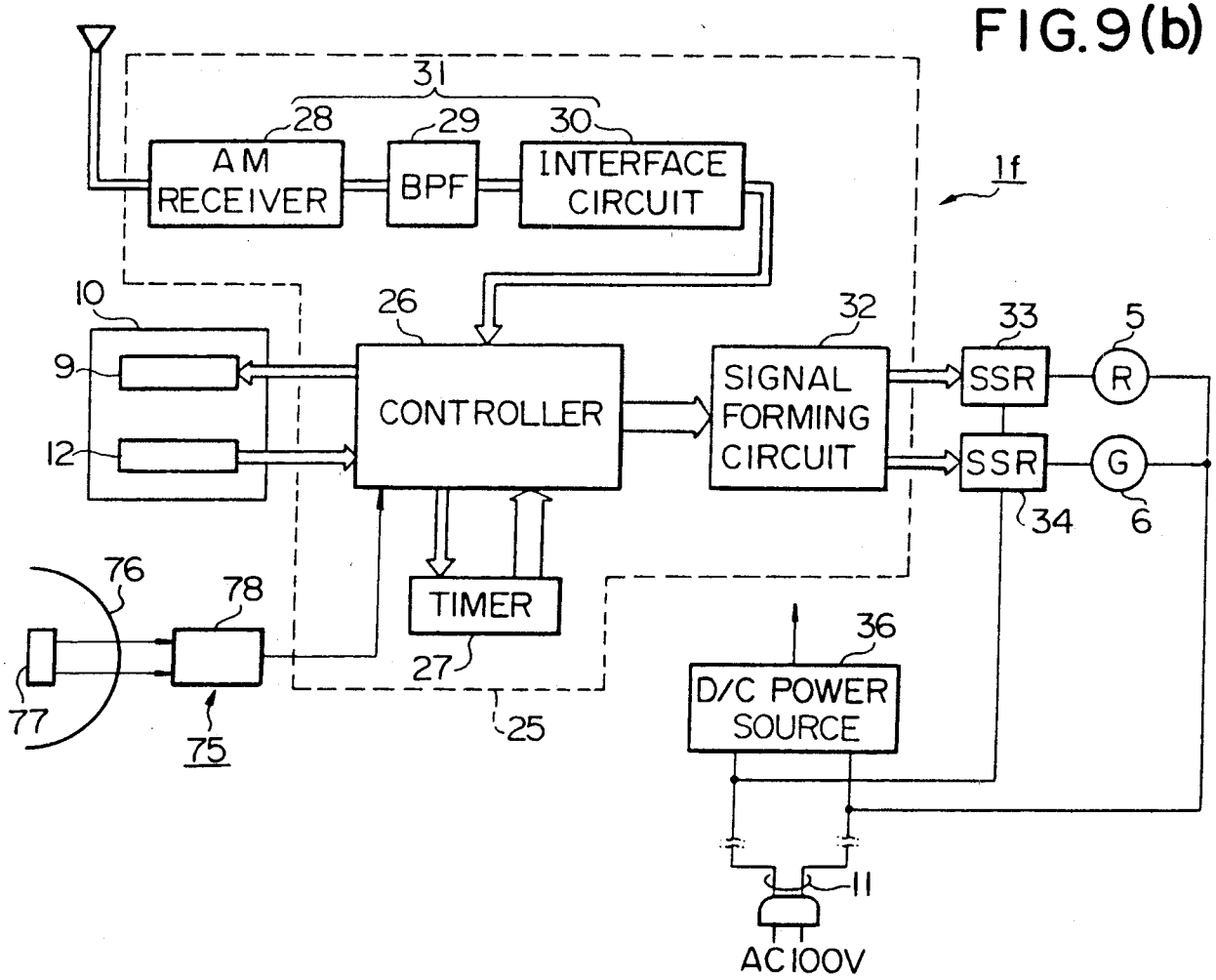

Fourth Embodiment (FIGS. 9(*a*) and 9(*b*))

A temporary signal system according to a fourth embodiment will be described with reference to FIGS. 9(*a*) and 9(*b*) in which FIG. 9(*a*) shows a circuit diagram of the parent signal stand 1e and FIG. 9(*b*) shows a circuit diagram of the child signal stand 1f.

In the fourth embodiment as illustrated in FIGS. 9(*a*) and 9(*b*), the parent and child signal stands 1e and 1f employ a sound signal such as an ultrasonic wave or the like as operation starting means.

That is, the parent signal stand 1e has an ultrasonic wave transmitter 70 for transmitting an ultrasonic wave signal when the start button 19 of parent 1e is pressed as shown in FIG. 9(*a*). The ultrasonic wave transmitter 70 has an oscillating element 71 for generating an ultrasonic wave, a reflex horn 72 for effectively transmitting the ultrasonic wave in a desired direction and a drive circuit 73 for giving a given drive signal to the oscillating element 71.

When the start button 19 of stand 1e is pressed, the controller 26 starts its operation to thereby drive the drive circuit 73. The child signal stand 1f has an ultrasonic wave receiver 75 for receiving the given ultrasonic wave signal and converting the ultrasonic wave into an electric signal for operating the controller 26 of stand 1f as shown in FIG. 9(*b*). The ultrasonic wave receiver 75 has a parabolic reflector 76, an oscillating element 77 for converting the ultrasonic wave focused by the parabolic reflector 76 into an electric signal and a drive circuit 78 for receiving the electric signal from the oscillating element 77 to thereby operate the controller 26 of stand 1f.

The arrangement of the temporary signal system of the fourth embodiment is the same as that of the second embodiment excepting the ultrasonic wave transmitter 70 and the ultrasonic wave receiver 75.

An operation of the temporary signal system according to the fourth embodiment will be described hereinafter.

The parent and child signal stands 1e and 1f are installed at opposite ends 42a and 42b of the construction site 41 in the same way as illustrated in FIG. 5.

In the parent signal stand 1e, if the start button 19 is pressed by the operator, the controller 26 starts its operation to drive the ultrasonic wave transmitter 70 so that the reflex horn 72 emits an ultrasonic wave to the child stand 1f for a given period. Whereupon the parabolic reflector 76 of the ultrasonic wave receiver 75 of the child signal stand 1f focuses the ultrasonic wave which is supplied to the oscillating element 77. The oscillating element 77 generates an electric signal which is supplied to the drive circuit 78. The drive circuit 78 starts to operate the controller 26 of stand 1f upon reception of the electric signal. Consequently, the controller 26 of the child signal stand 1f starts its operation while maintaining synchronization in the flashing operation of the red and green lights of both signal stands 1e and 1f. If a memory is provided at the child signal stand 1f and the interval between both the parent and child signal stand is stored in the memory of the child stand 1f as a correction value, then accurate synchronization can be made between the red and green lights of both the parent and child signal stands 1e and 1f.

Both the parent and child signal stands 1e and 1f operate according to the processes illustrated in the flow charts of FIGS. 6(*a*) and 6(*b*).

Inasmuch as the signal stand 1f starts its operation upon reception of the ultrasonic wave emitted by the signal stand 1e, there occurs scarcely any deviation in the synchronization of the flashing operations of the red and green lights of the parent and child signal stands 1e and 1f.

Although an ultrasonic wave has been employed by the fourth embodiment, an ordinary sound wave signal can also be employed.

The operation starting means set forth in the first to fourth embodiments are not limited to those set forth above but can be modified.

Figure 10:
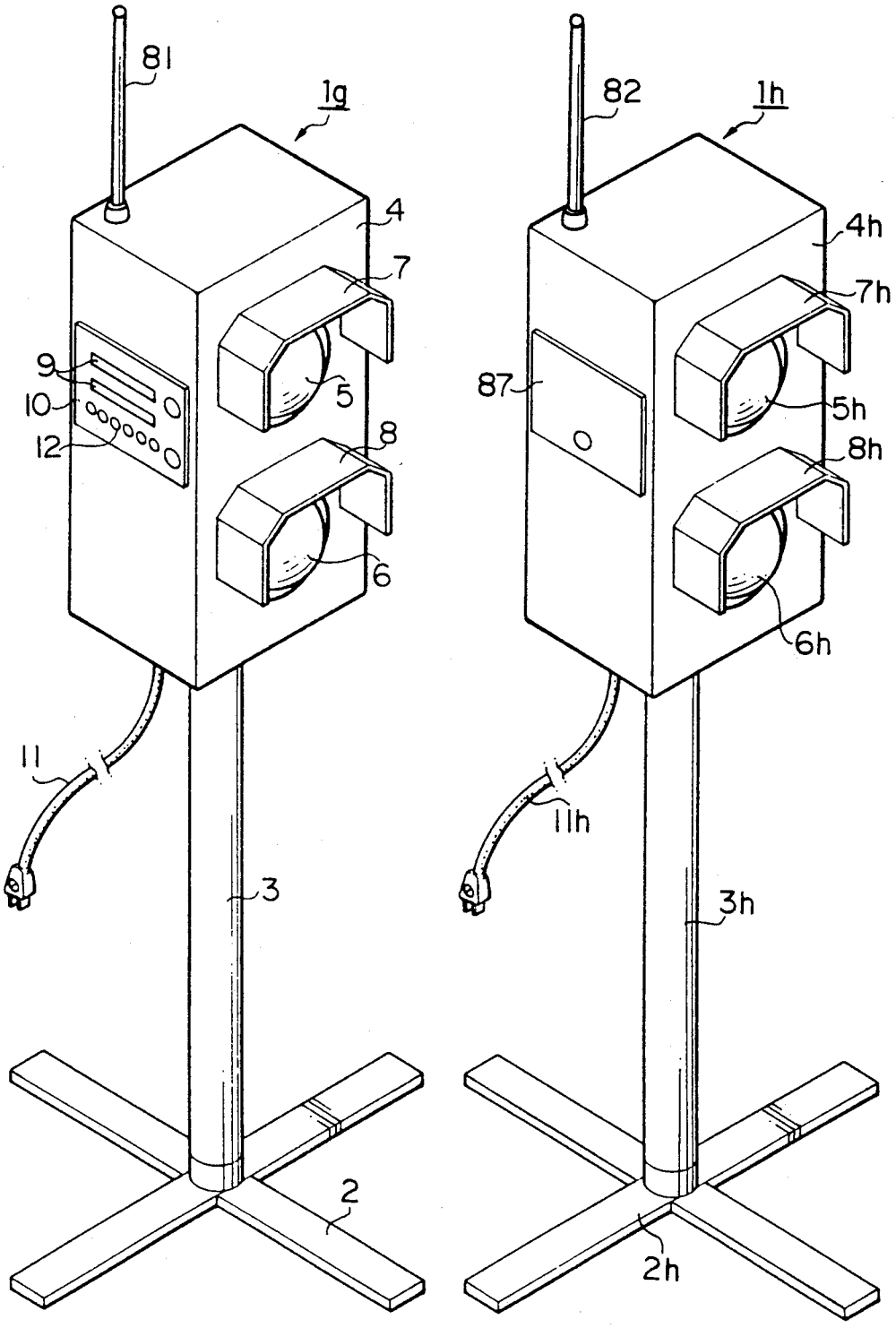
FIG. 10 is a perspective view showing parent and child signal stands of a temporary signal system according to a fifth embodiment of the present invention.
Figure 11A:
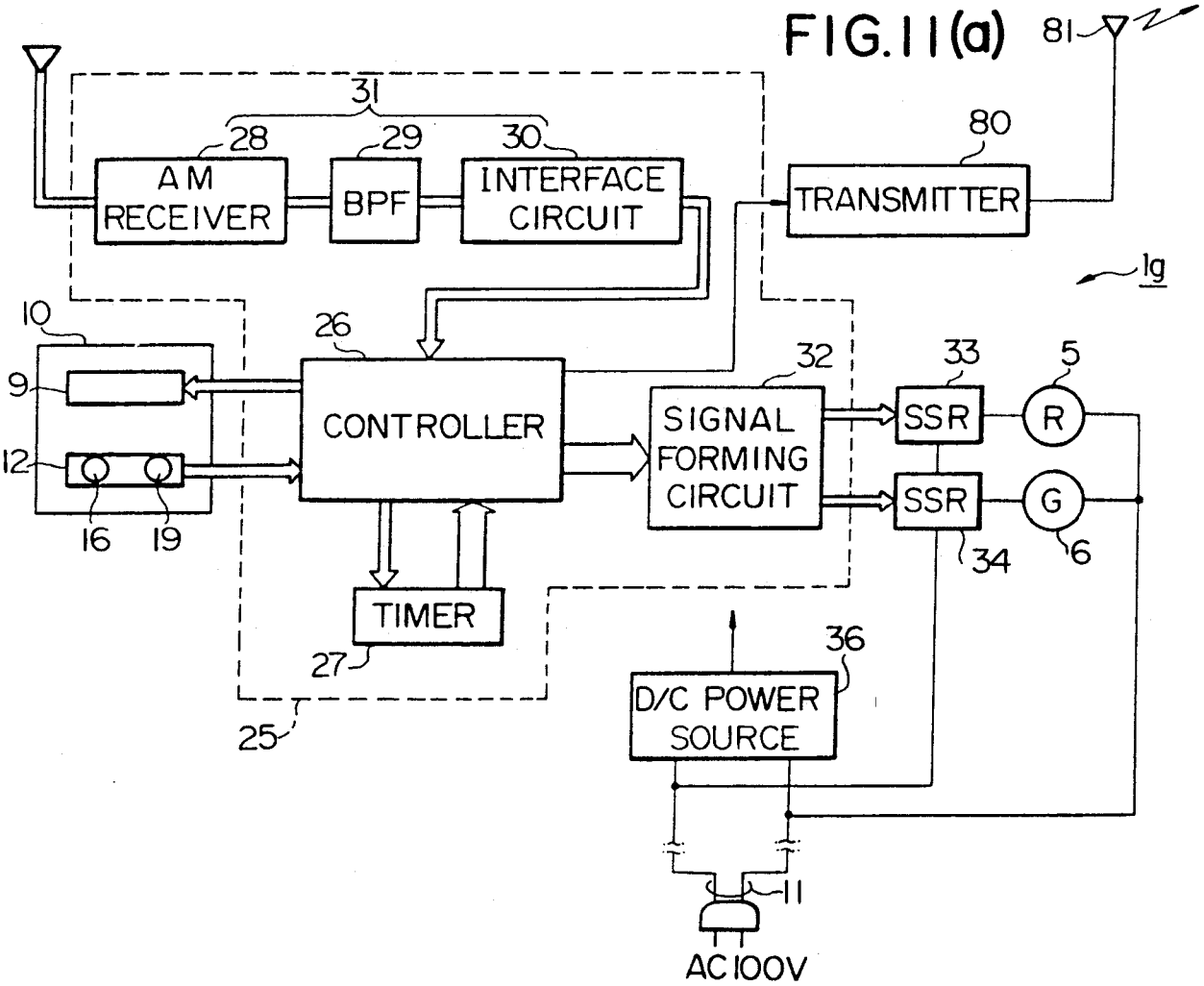
FIG. 11(*a*) is a circuit diagram of the parent signal stand and FIG. 11(*b*) is a circuit diagram of the child signal stand for the embodiment of FIG. 10.
Figure 11B:
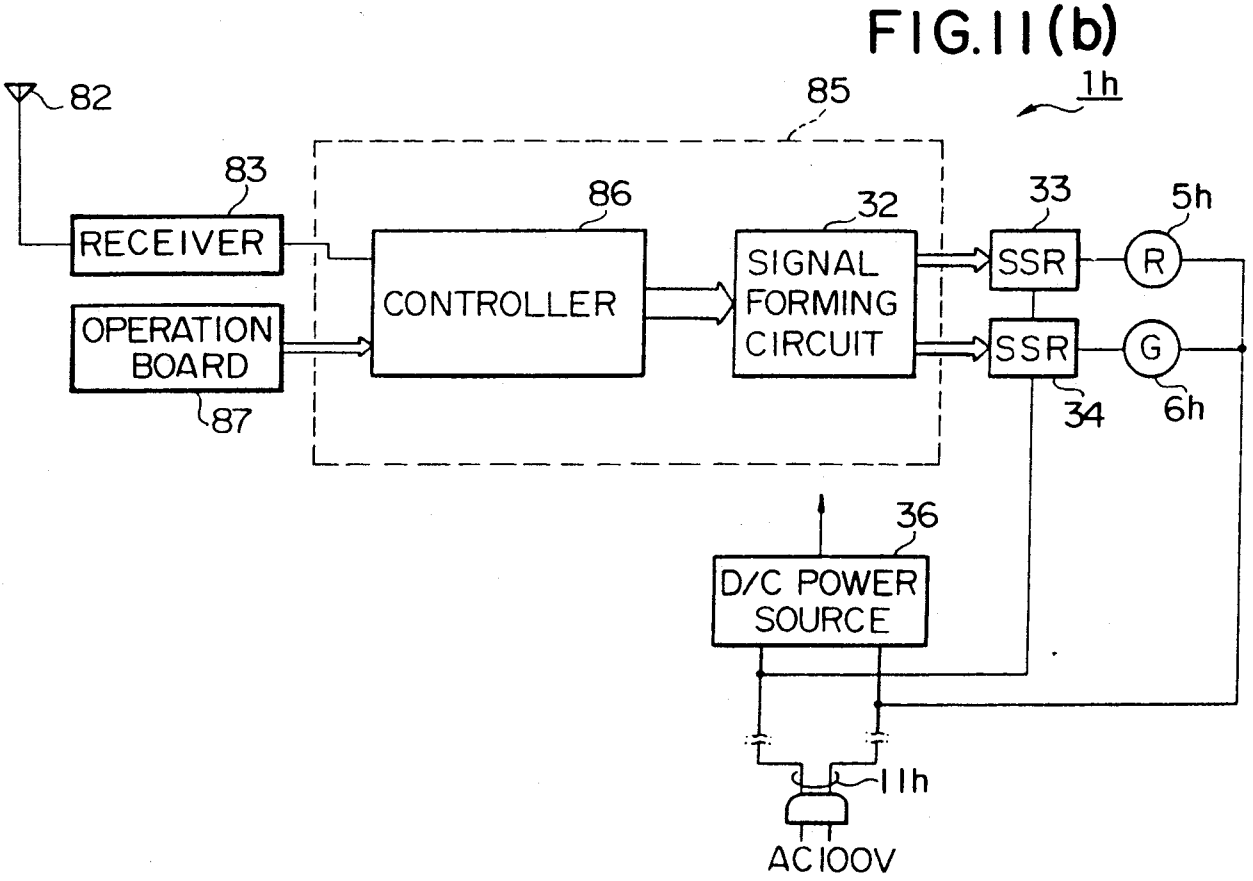

Fifth Embodiment (FIGS. 10, 11(*a*) and 11(*b*))

A temporary signal system according to a fifth embodiment will be described with reference to FIGS. 10, 11(*a*) and 11(*b*).

The parent temporary signal system of the fifth embodiment has a parent signal stand 1*g* provided with an antenna 81 to transmit the initialized data such as flashing time, flashing interval, periodic variation value at day and night time and the like. The parent signal stand 1*g* can operate based on the initialized values and cooperate with a child signal stand 1*h* provided with an antenna 82 for receiving radio wave signals from antenna 81 so that the parent signal stand 1*g* can control the child signal stand 1*h*. Accordingly, the child signal stand 1*h* is completely under the control of the parent signal stand 1*g*.

The flashing operations of both the red and green lights of the child signal stand 1*h* are synchronized with each other by the radio wave emitted by the parent signal stand 1*g*, details of which are described with reference to FIGS. 11(*a*) and (*b*).

If the push button 19 of stand 1*g* is pressed, another control signal, which is synchronous with a flashing control signal supplied from the controller 26 to the signal forming circuit 32, is supplied to the transmitter 80. The transmitter 80 supplies a given radio wave in response to the other control signal to the antenna 81. The radio wave is thus emitted in the air from the antenna 81.

In the child signal stand 1*h*, the antenna 82 receives the radio wave signal emitted by the antenna 81 of the parent signal stand 1*g* and supplies the received radio wave to the receiver 83 which forms a control signal corresponding to the received radio wave. The control signal is supplied to the control portion 85. The control portion 85 comprises a controller 86 for permitting both the red light 5*h* and the green light 6*h* to flash in response to the control signal and a signal forming circuit 32 having the same arrangement as the first embodiment. The controller 86 is connected to an operation board 87 provided with switches for tuning on or off the power supply or testing the operation. The signal forming circuit 32 is connected to the switching elements 33 and 34 the same as the first embodiment. The switching elements 33 and 34 receive a triggering signal from the signal forming circuit 32 and permit the red light 5*h* and the green light 6*h* to flash. A direct current power supply is supplied to each component of the parent and child signal stands 1*g* and 1*h*.

According to the fifth embodiment, both the parent and child signal stands 1*g* and 1*h* are installed at opposite ends 42*a* and 42*b* of the construction site 41. Thereafter, the operation condition of the parent signal stand 1*g* is initialized (i.e. programmed into the controller 26) and the start button 19 of the parent signal stand 1*g* is then pressed by the operator. As a result, the controller 26 starts its operation and supplies a flashing control signal to its signal forming circuit 32 and also supplies the other control signal which is synchronous with the flashing control signal to the transmitter 80. The transmitter 80 emits a radio wave signal from the antenna 81. The emitted radio wave was subjected to an amplitude modulation or frequency modulation by the other control signal.

In the child signal stand 1*h*, the receiver 83 receives the radio wave signal from the parent stand by way of the antenna 82 and produces a control signal and supplies this control signal to the controller 86. The controller 86 thus operates upon reception of the control signal under the control of the parent signal stand 1*g* so as to appropriately energize the red and green lights of the child stand in dependence on the control signals received from the parent stand.

Inasmuch as the child signal stand 1*h* is operated by the control signals supplied from the parent signal stand 1*g*, synchronization in the flashing operations of the red and green lights in the parent and child stands can be achieved.

Figure 12A:
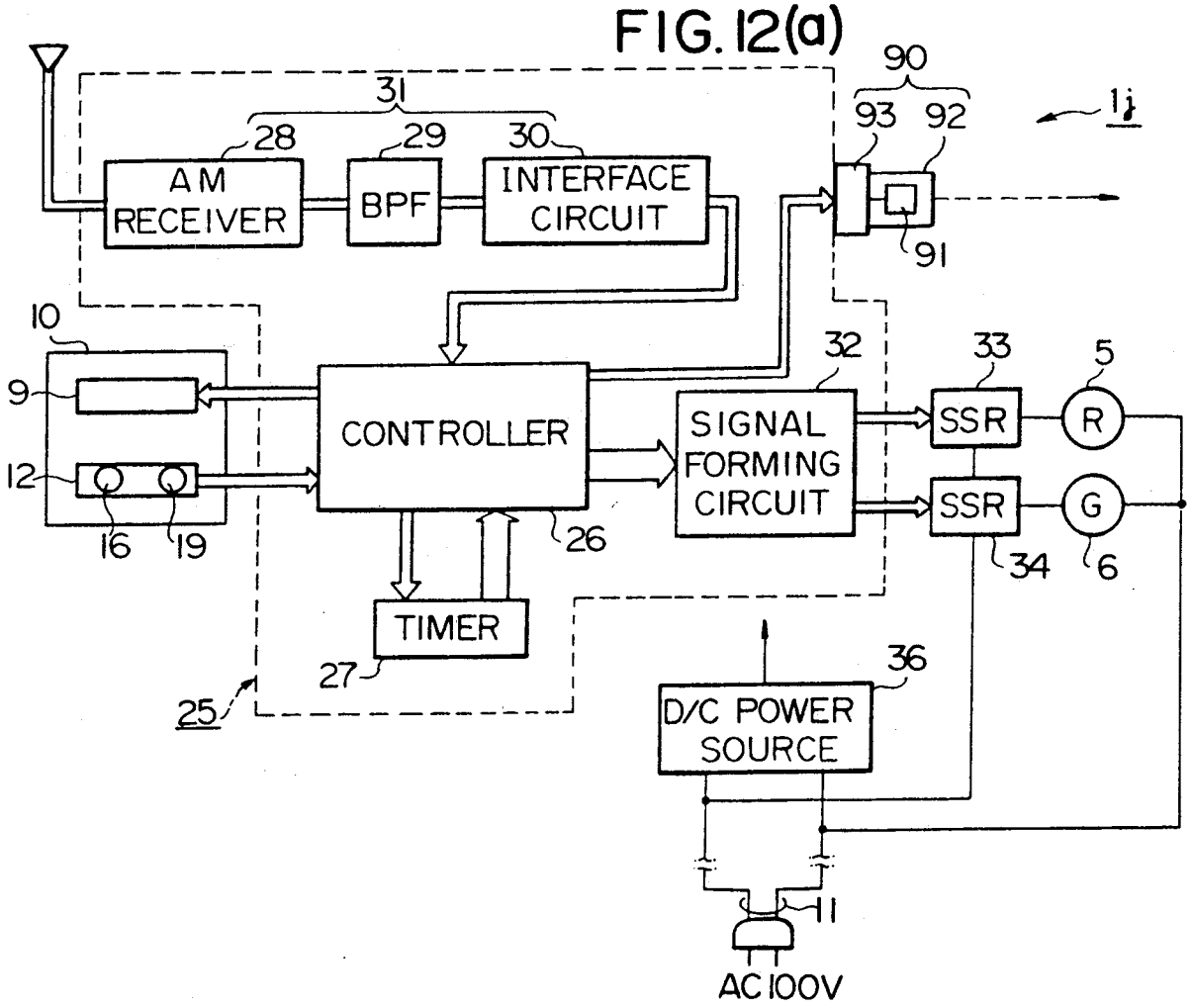
FIG. 12(*a*) is a circuit diagram of a parent signal stand and FIG. 12(*b*) is a circuit diagram of a child signal stand respectively of a temporary signal system according to a sixth embodiment of the invention.
Figure 12B:
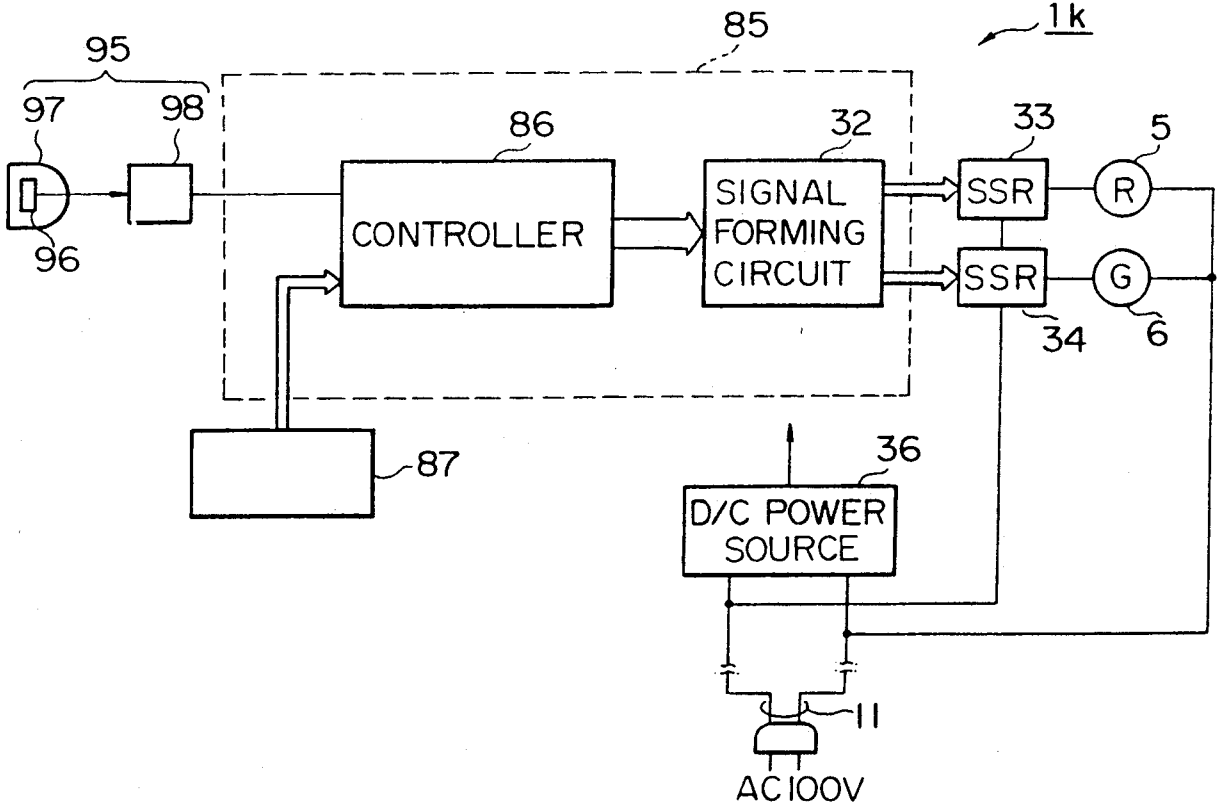
Figure 13:
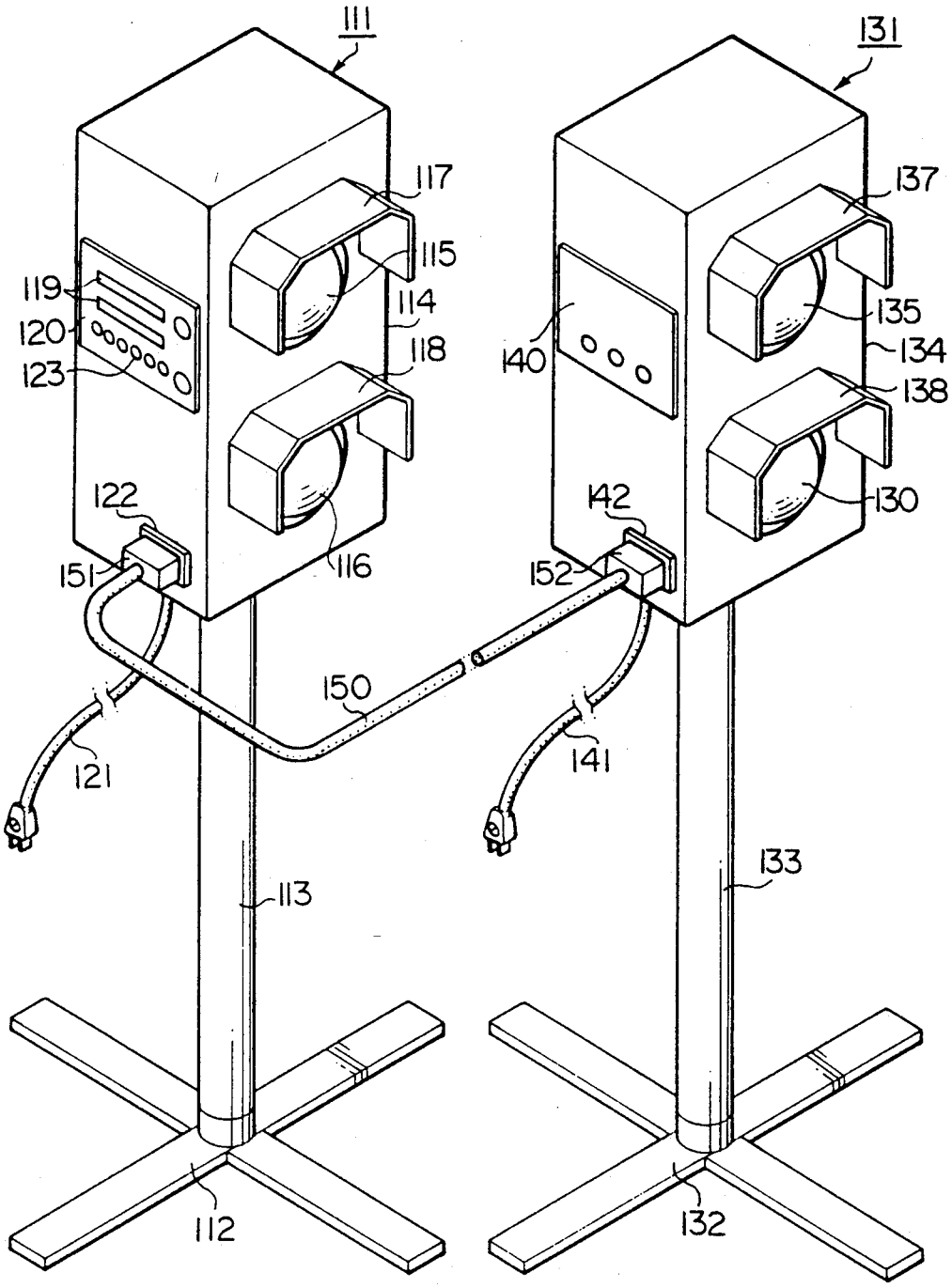
FIG. 13 is a perspective view showing parent and child signal stands of a temporary signal system according to a seventh embodiment of the invention.

Sixth Embodiment (FIGS. 12(*a*) and 12(*b*))

A temporary signal system according to a sixth embodiment will be described with reference to FIGS. 12(*a*) and 12(*b*) in which FIG. 12(*a*) shows a circuit diagram of the parent signal stand 1*j* and FIG. 12(*b*) shows a circuit diagram of the child signal stand 1*k*.

The temporary signal system of the sixth embodiment has a parent signal stand 1*j* and a child signal stand 1*k* which is operated under the control of the parent signal stand 1*j* wherein the red and green lights of the child signal stand 1*k* are synchronous with each other by a laser beam or the like emitted by the parent signal stand 1*j*.

The parent signal stand 1*j* has a light transmitting means 90 for transmitting a light signal, e.g. an infrared laser beam signal, when the start button 19 is pressed as illustrated in FIG. 12(*a*). The light emitting means 90 comprises a light emitting device 92 incorporating therein an infrared laser beam emitting element 91 for emitting the infrared laser beam and a drive circuit 93 for turning on or off the infrared laser beam emitting element 91. The detailed arrangement of the light emitting means 90 is substantially the same as that of the third embodiment (refer to FIG. 8(*a*)).

The child signal stand 1*k* has a light receiving device 95 for receiving the infrared laser beam and converting the thus received laser beam signal into an electric signal, thereby operating a controller 86 of a control portion 85. The light receiving device 95 has the same arrangement as the third embodiment (refer to FIG. 8(*b*)) and comprises a light receiving element 96, an optical system 97 for effectively focusing the infrared laser beam into the light receiving element 96 and a wave rectifier 98 for forming a control signal to drive the controller 86 upon reception of an electric signal from the light receiving element 96 of the optical system 97.

The arrangement of the sixth embodiment is the same as the fifth embodiment (refer to FIG. 11(*b*)) excepting the components set forth just above.

According to the sixth embodiment, both the parent and child signal stands 1*j* and 1*k* are respectively installed at opposite ends 42*a* and 42*b* of the construction site 41 in the same way as illustrated in FIG. 5. Thereafter, the operating condition of the parent stand 1*j* is initialized (i.e. programmed into controller 26) and the start button 19 of the parent signal stand 1*j* is then pressed so that the controller 26 starts its operation. The controller 26 drives the light emitting means 90 so that the light emitting device 92 can emit a laser beam signal in response to the other control signal. Accordingly, in the child signal stand 1*k*, the light receiving device 95 receives the laser beam signal which is detected by the light receiving element 96 and rectified by the wave rectifier 97 where the control signal is produced for driving the controller 86. Consequently, the controller 86 of the child signal stand 1*k* operates in accordance with the control signals under the control of the parent signal stand 1*j*. In this case, inasmuch as the child signal stand 1*k* operates upon reception of the laser beam signals from the parent signal stand 1*j*, synchronization of the flashing operations between the red and green lights of both the parent and child signal stands 1*j* and 1*k* occurs.

Although a laser beam has been used according to the sixth embodiment, an ordinary infrared light signal or the like can be used.

Inasmuch as the operations of both the parent and child signal stands can be started by the operation starting means and the flashing operations of the signal lights can be synchronized with each other, a signal transmitting cable for connecting the parent and child stands is not necessary. Therefore, the temporary signal system can be handled with ease while the signal lights flash.

Seventh Embodiment (FIGS. 13 to 19)

A temporary signal system according to a seventh embodiment will be described with reference to FIGS. 13 to 19.

The parent signal stand 111 can set initial values for flashing time, flashing interval or periodic variation for day and night and the like. The initial values set by the parent signal stand 111 can be transmitted to the child signal stand 131 by way of a temporary or removable cable 150 having plugs 151 and 152 at opposite ends thereof. The electrical circuits incorporated in both the parent and child signal stands can be electrically connected by inserting the plugs 151 and 152 into connectors 122 and 142, respectively.

As a result, the child signal stand 131 stores the initial values for synchronization of flashing operations of the red and green lights of the parent signal stand 111 and matches the operation starting time with that of the parent signal stand 111. After completion of the initialization, the cable 150 is disconnected from the connectors 122 and 142. Thereafter, both the parent and child signal stands 111 and 131 are installed in the positions where the traffic needs to be controlled.

Figure 14:
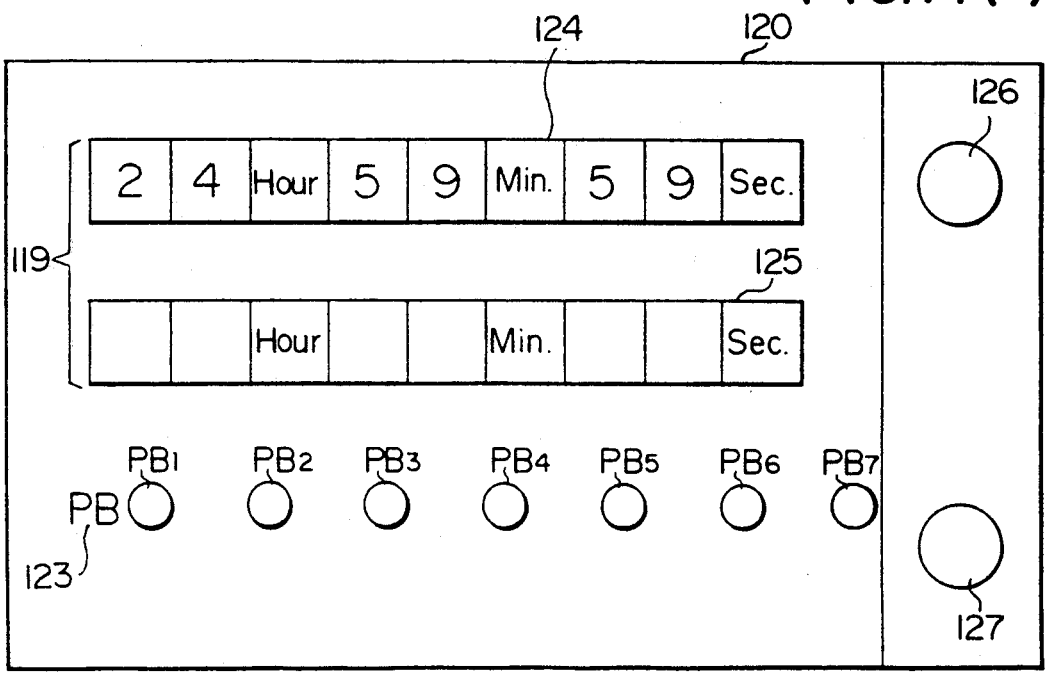
FIGS. 14A and 14B are front views showing an operation board of the parent signal stand of FIG. 13.
Figure 14:
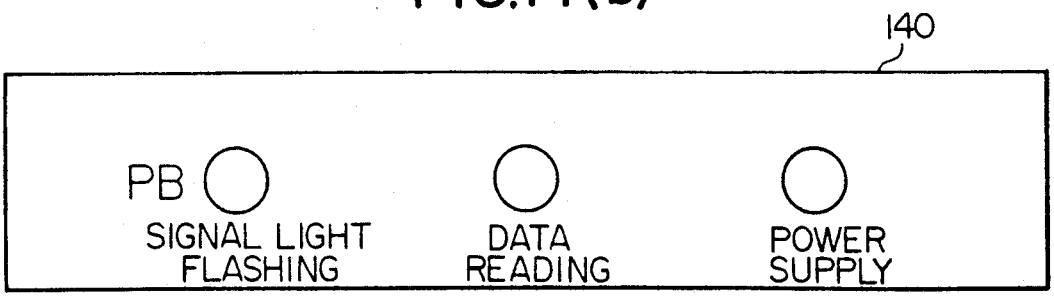

In FIG. 14(*a*), the operation board 120 has an indication portion 119 and an operation portion 123. The operation portion 119 has an indication panel 124 for indicating the actual time at its upper portion and an indication panel 125 for indicating the setting value at its lower portion. The operation portion 123 comprises bush buttons PB1 to PB7 and mode selection switches 126 and 127. The push button PB1 can set the present time. The push button PB2 can set the flashing time $T_1$ for permitting the green light 116 of the parent signal stand 111 to flash, while the push button PB3 can set the flashing time $T_2$ for permitting the green light 136 of the child signal stand 131 to flash. The push button PB4 can set the overlap time $T_3$ of both the red lights 115 and 135 of parent and child signal stands 111 and 131. The push button PB5 sets the start of flashing operation, while the push button PB6 sets the completion of the flashing operation. The mode selection switch 126 selects an operation mode or a setting mode, while the mode selection switch 127 selects a normal operation mode or a red light flashing operation mode.

The operation board 140 as illustrated in FIG. 14(*b*) functions to turn on or off the power source or operate in the minimum requirements.

Figure 15:
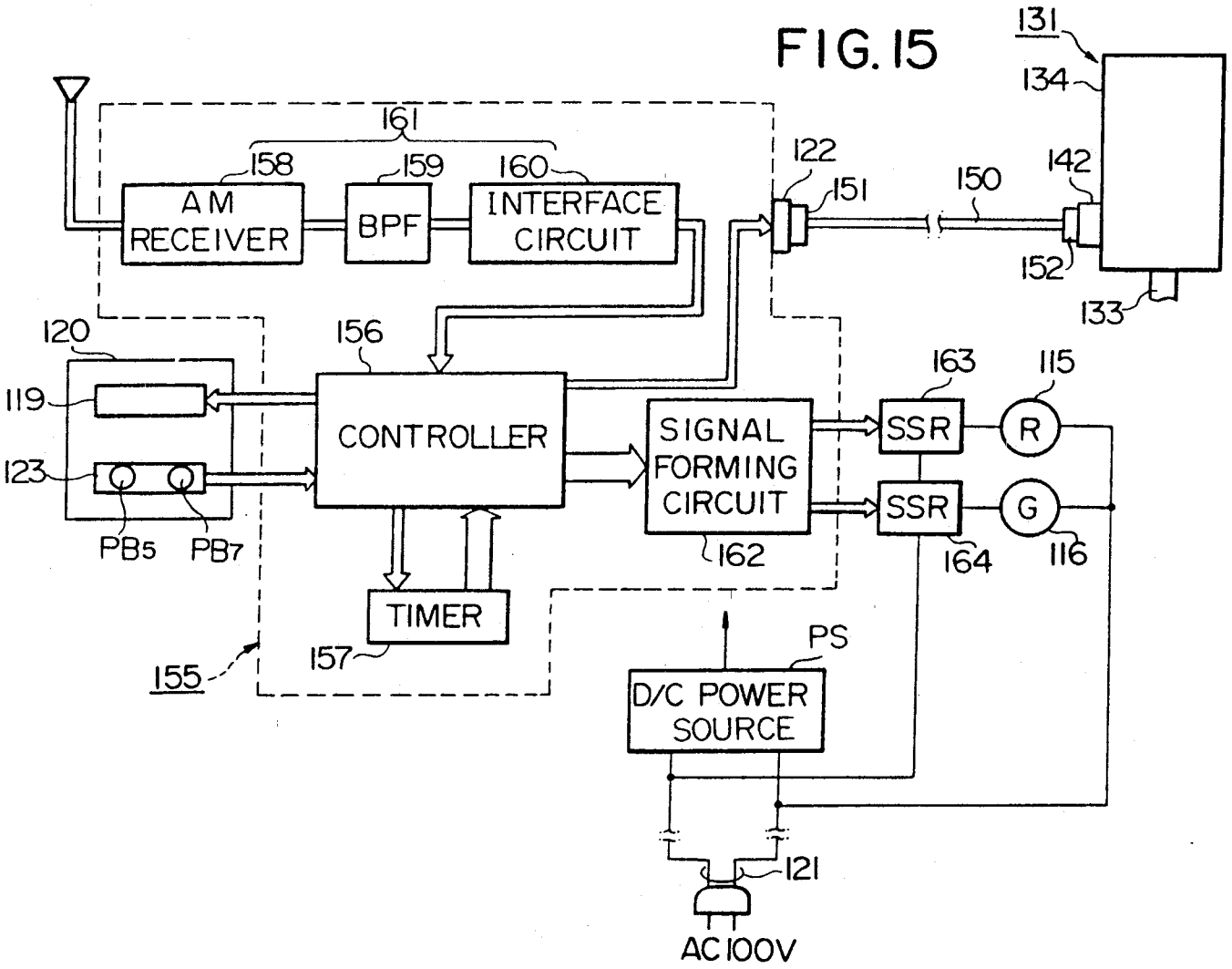
FIG. 15 is a circuit diagram of the parent signal stand of FIG. 13.

In FIG. 15, the control portion 155 comprises a controller 156 composed of, e.g. an 8 bit microcomputer provided with a RAM and ROM as memory means, a 24-hour working timer 157 which is controlled by the controller 156 and supplies the present time to the controller 156, a time correction circuit 161 composed of an amplitude modulation (AM) receiver 158, a band path filter (BPF) 159 for extracting a time tone received by the AM receiver 158 and an interface circuit 160 for rectifying a wave of the thus extracted signal and producing a time correction signal which is supplied to the controller 156, a signal forming circuit 162 for producing a triggering signal upon reception of the flashing control signal supplied by the controller 156, and a connector 122 for transmitting data set by the controller 156 and a synchronous signal to an exterior device. Denoted at PS is a direct current power source.

The controller 156 is connected to the indication portion 119 and operation portion 123 of the operation board 120 while the signal forming circuit 162 is connected to switching elements 163 and 164 respectively composed of, e.g. solid-state relays (SSRs) or the like. The switching elements 163 and 164 permit the red and green lights 115 and 116 respectively connected to the commercial power source to flash upon reception of the triggering signal from the signal forming circuit 162. Lighting driving means comprises the signal forming circuit 162 and the switching elements 163 and 164. The setting data and the synchronous signal stored in the controller 156 can be transmitted to the child signal stand 131 by way of the connectors 122, 151, the cable 150 and the plugs 152, 142.

Figure 16:
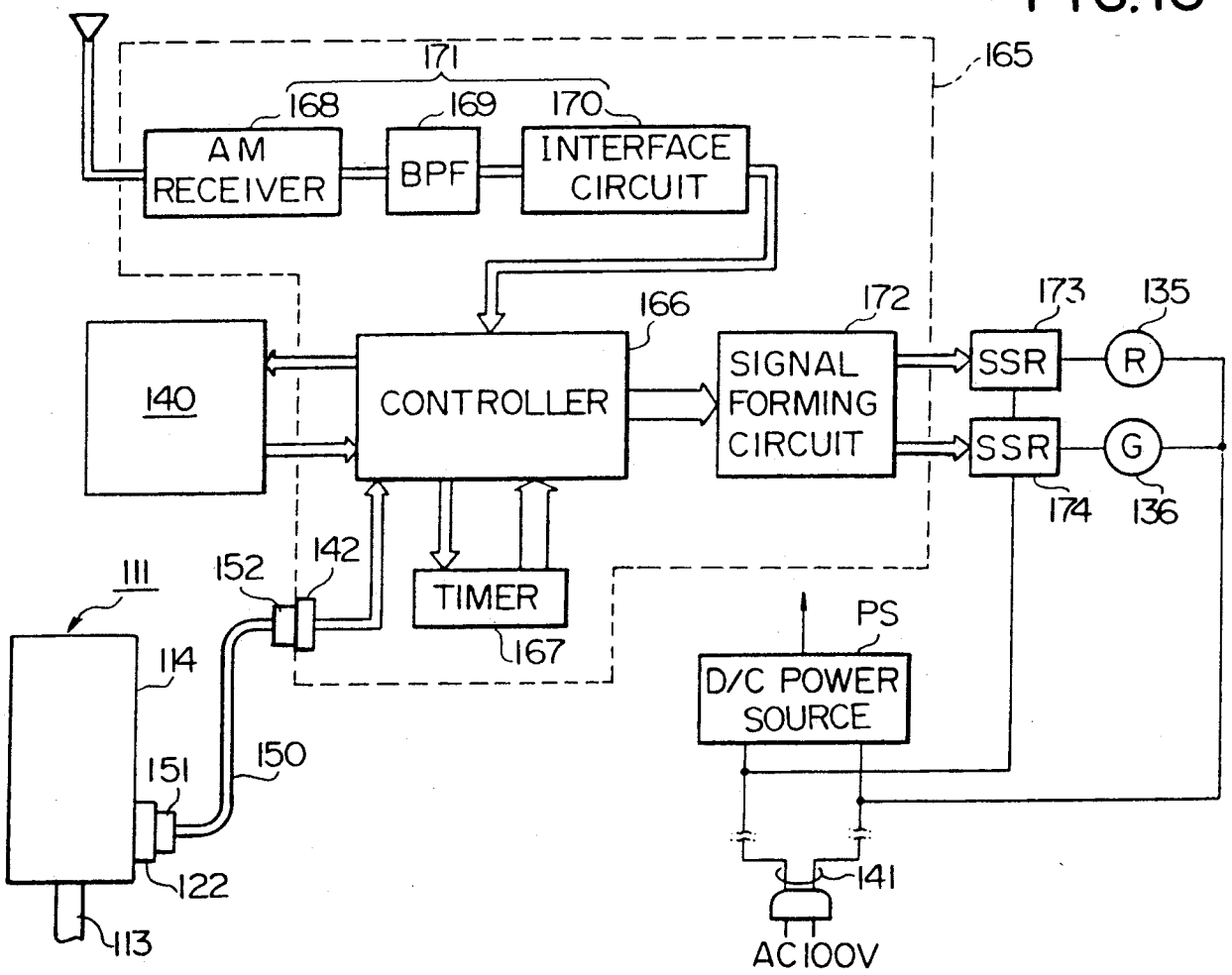
FIG. 16 is a circuit diagram of the child signal stand of FIG. 13.

In FIG. 16, showing a circuit diagram of the child signal stand 131, the control portion 165 comprises a controller 166 composed of, e.g. an 8 bit microcomputer provided with a RAM and a ROM as memory means, a 24-hour working timer 167 which is controlled by the controller 166 and supplies the present time to the controller 166, a time correction circuit 171 composed of an amplitude modulation (AM) receiver 168, a band path filter (BPF) 169 for extracting a time tone received by the AM receiver 168 and an interface circuit 170 for rectifying a wave of the thus extracted signal and producing a time correction signal which is supplied to the controller 166, a signal forming circuit 172 for producing a triggering signal upon reception of the flashing control signal supplied by the controller 166, and a connector 142 for transmitting data set by the controller 166 and a synchronous signal to an exterior device. Denoted at PS is a direct current power source.

The controller 166 is connected to the operation board 140 while the signal forming circuit 172 is connected to switching elements 173 and 174 respectively composed of, e.g. solid-state relays (SSRs) or the like. The switching elements 173 and 174 permit the red and green lights 135 and 136 respectively connected to the commercial power source to flash upon reception of the triggering signal from the signal forming circuit 172. Lighting driving means comprises the signal forming circuit 172 and the switching elements 173 and 174. The setting data and the synchronous signal stored in the controller 156 can be transmitted to the child signal stand 131 by way of the connectors 122, 151, the cable 150 and the plugs 152, 142.

Figure 17:
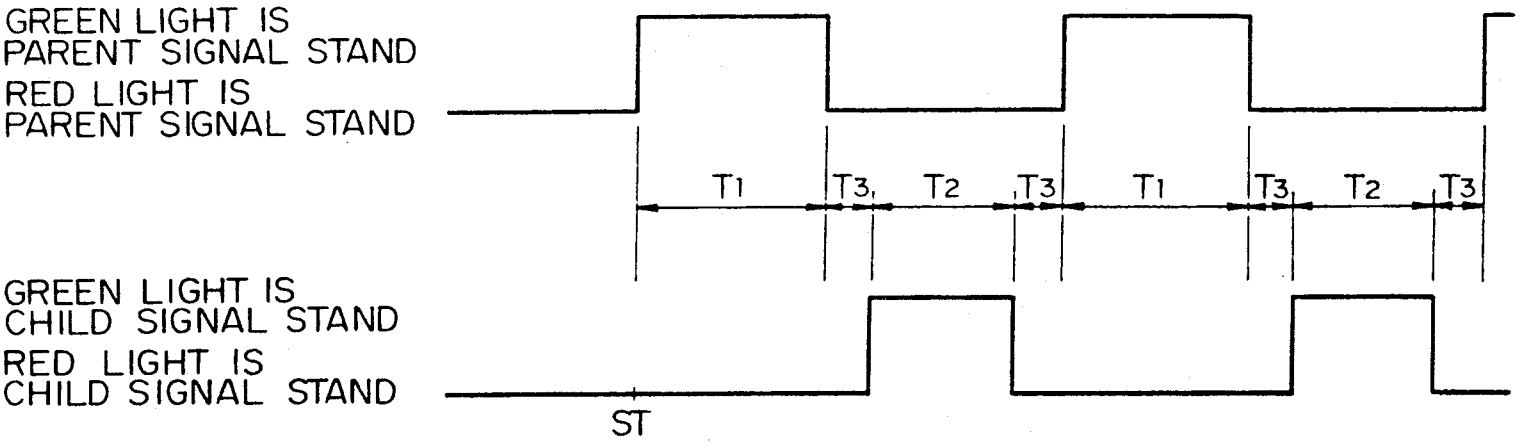
FIG. 17 is a timing chart showing operation of the temporary signal system according to the seventh and eighth embodiments of the invention.
Figure 18:
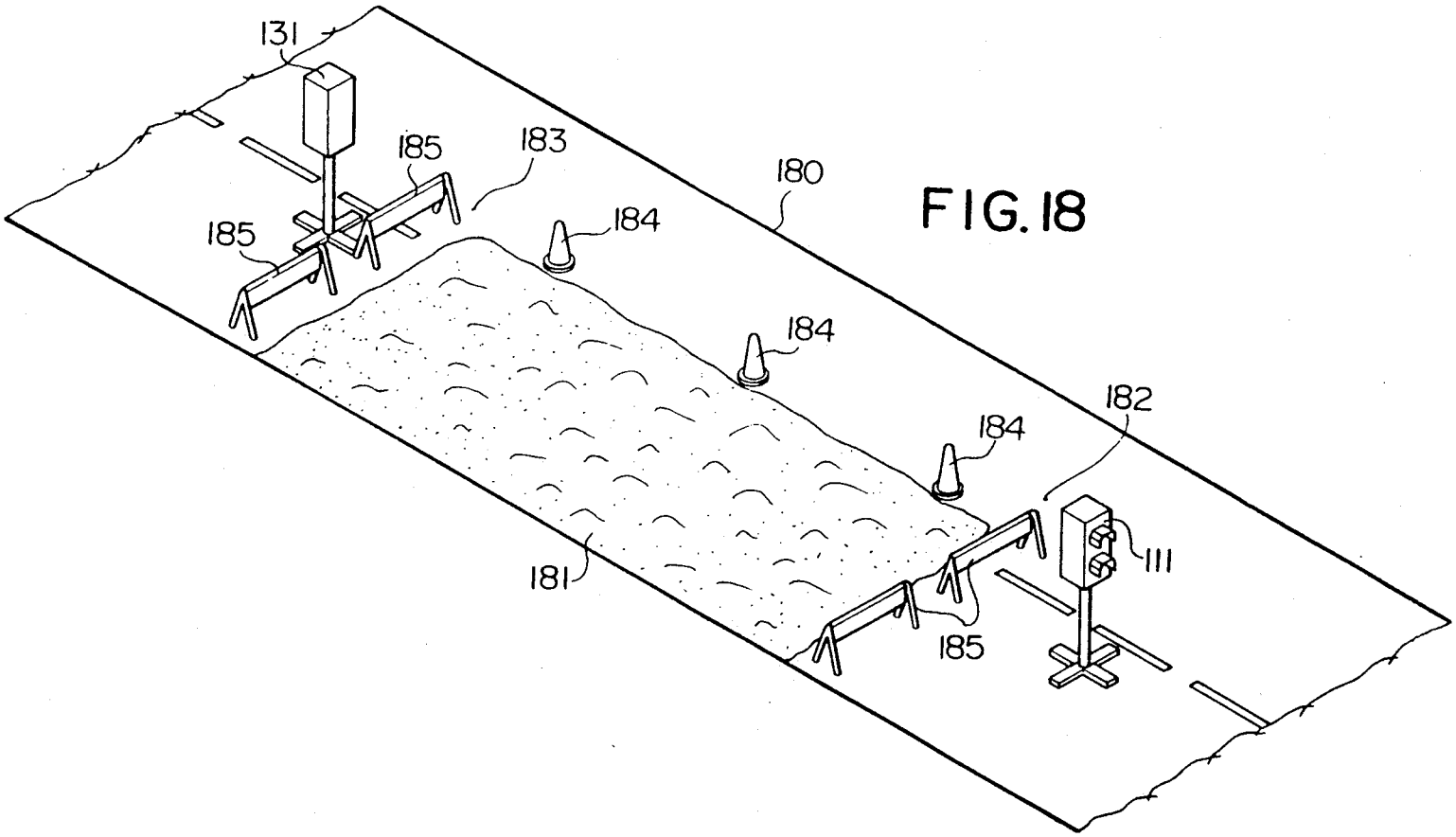
FIG. 18 is a perspective view showing the employment of the temporary signal system at a construction site according to the seventh and eighth embodiments of the invention.
Figure 19:
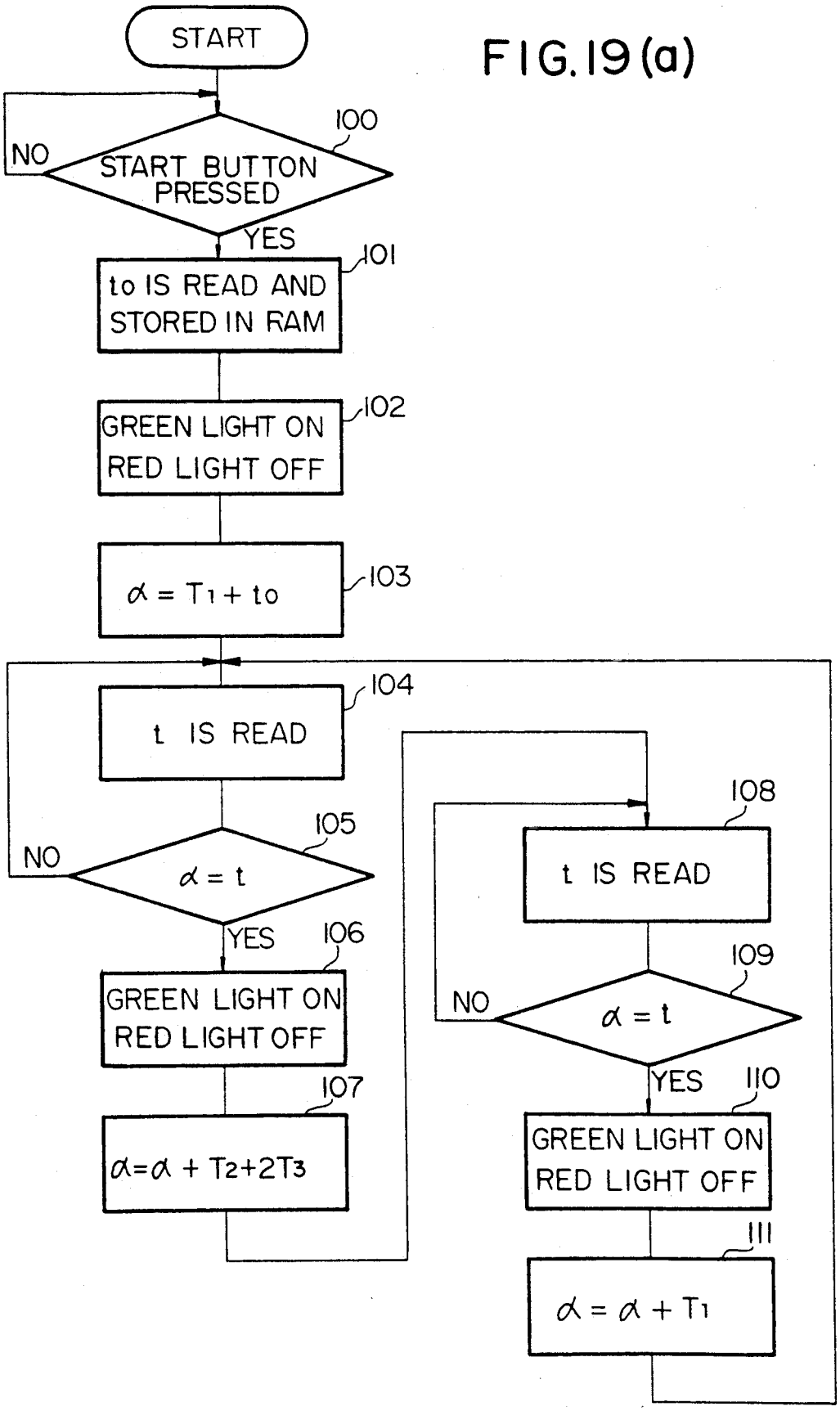
FIGS. 19(*a*) and (*b*) are flow charts showing procedures of operation of the temporary signal system according to the seventh and eighth embodiments of the invention.
Figure 19B:
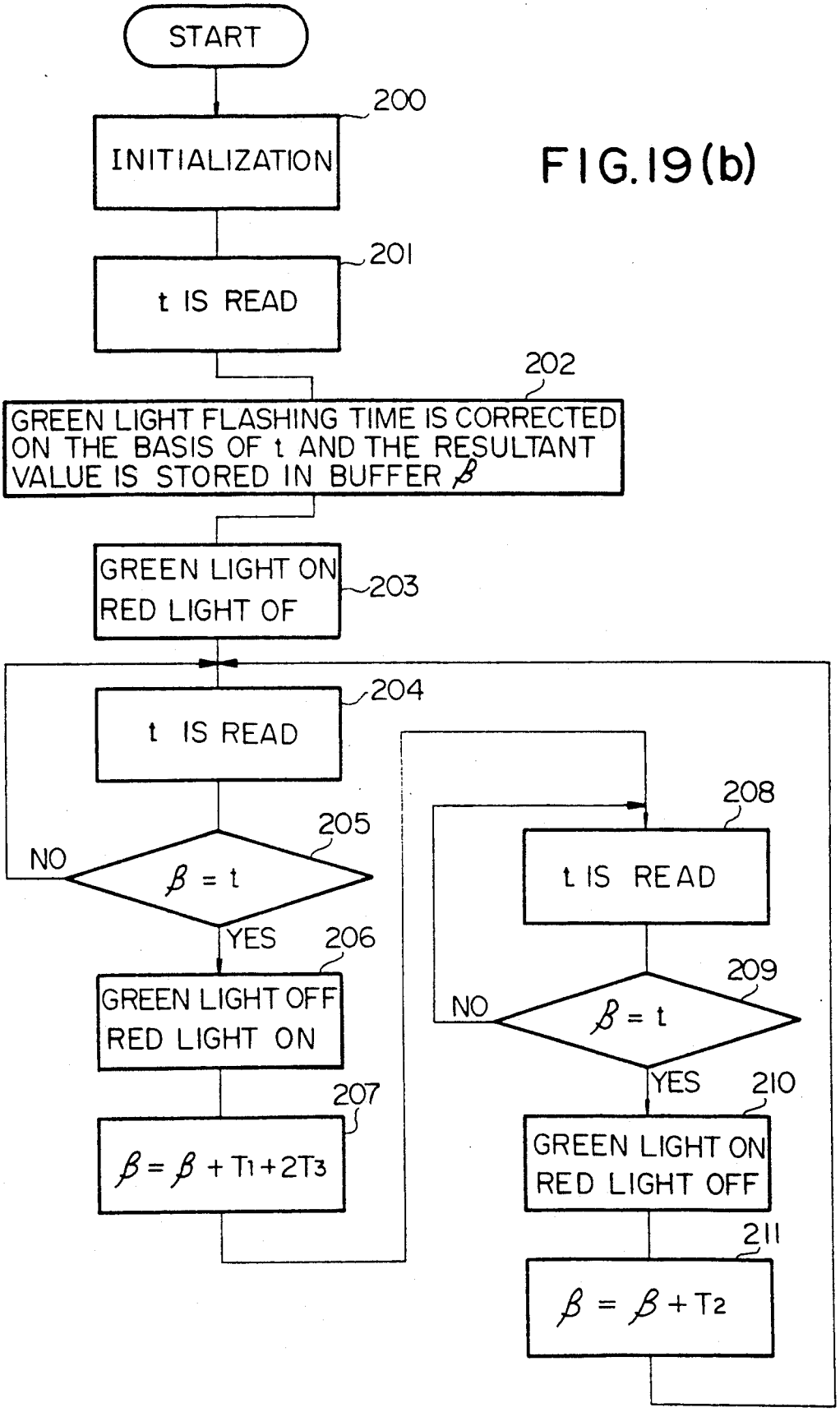

An operation of the temporary signal system having an arrangement set forth above will be described with reference to FIGS. 17 to 19.

Initialization

It is necessary to initialize for determining the operations of the signal stands 111 and 131 having the same arrangement.

The two signal stands 111 and 131 are positioned at one spot so as to be close to each other so that a flashing condition for the red lights 115, 135 and green lights 116, 136 is set to an appropriate value. This is done by the operations of the mode selection switch 126 and the push buttons PB2 to PB4. That is, the mode selection switch 126 selects the setting mode while the push buttons PB2 to PB4 set the data for operating the red and green lights during the specific period, a flashing time $T_1$ of the green light 116 of the parent stand 111, the flashing time $T_2$ of the green light 136 of the child stand 131 and an overlap time $T_3$ of both the red lights 115 and 135 of the parent and child signal stands 111 and 131. If need be, the push button PB1 is pressed to thereby set the present time which is supplied to the parent signal stand 111. The times $T_1$ to $T_3$ are set to an optimum value depending on the shape of the road, length of the construction site, the period of time at day and night, etc. The operation portion 123 of the operation board 120 can be operated for setting the other requisite conditional value.

After completion of the initialization, the parent signal stand 111 is connected to the child signal stand 131 by the cable 150. Then, when the push button PB7 of the operation board 120 is pressed, the operation time data, the setting data for the duration of the flashing times $T_1$ to $T_3$, the present time data and the synchronous data stored in the controller 156 of the parent signal stand 111 are supplied to the controller 166 of the child signal stand 131 by way of the connector 122, the plug 151, the cable 150, the connector 152 and the plug 142.

Consequently, the child signal stand 131 stores each data into the RAM of the controller 156 and operates the timer 167 at the same time as that of the parent signal stand 111 based on the data stored in the RAM and starts to form the flashing control signal based on the setting data during the flashing times $T_1$ to $T_3$. The flashing operations of both the red light 135 and the green light 136 are not effected by the operation of the operation board 140.

Installation of Signal Stands

After completion of the initialization, the cable 150 is removed from the parent and the child signal stands which are then installed at the locations where the traffic is controlled.

During the interval when the parent and child signal stands 111 and 131 are carried to the installing area, i.e. the one end 182 and the other end 183 of the construction site 181, both controllers 156 and 166 and timers 157 and 167 are operated by power supplied from the batteries in order to keep the data stored in the RAM. The construction site 181 may be partitioned by pylons 184, the gates 185 or the like.

Starting Operation of the Signal Stands

After completion of the installation, both the parent and child signal stands 111 and 131 are operated. Since the initial value and the actual time are already stored in both the parent and child signal stands 111 and 131, they start operation immediately when the power is supplied to them by way of the cables 121 and 141. Both the parent and child signal stands 111 and 131 respectively start operations based on the initial setting value in accordance with the flow charts illustrated in FIGS. 19(*a*) and 19(*b*).

In the parent signal stand 111, when the start button PB5 is pressed (Step 100), the controller 156 reads the actual time $t_0$ of the timer 157 and stores it into the RAM (Step 101), and at the same time produces and supplies the flashing control signal for permitting the green light 116 to flash and the red light 115 not to flash (Step 102). Consequently, the controller 156 adds the flashing time, i.e. setting value $T_1$ to the actual time $t_0$ and stores the resultant value into a buffer $\alpha$ (Step 103). Thereafter, the controller 156 reads the actual time t in the timer 157 (Step 104) and compares it with the value stored in the buffer $\alpha$ (Step 105) and produces and supplies a flashing control signal and repeats the procedure if the actual time t does not coincide with the value stored in the buffer $\alpha$ and lighting out the green light 116 not to flash and permitting the red light 115 to flash if the actual time t coincides with the value stored in the buffer (Step 106).

Subsequently the controller 156 adds the time $T_2+2T_3$ to the present value and stores the resultant value in the buffer $\alpha$ (Step 107). Then the controller 156 reads the actual time t of the timer 157 (Step 108), compares it with the value stored in the buffer $\alpha$ (Step 109) and produces and supplies flashing control signal and repeats the procedures if the actual time t does not coincide with the value stored in the buffer $\alpha$ and permits the green light 116 to flash and the red light 115 not to flash if the actual time t coincides with the value stored in the buffer (Step 110). Thereafter the controller 156 adds the setting value $T_1$ to the value of the present buffer $\alpha$ and stores the resultant value in the buffer $\alpha$ (Step 111). The procedure is then jumped to the Step 104 and is repeated during the operation setting period. The time $t_0$ stored in the RAM of the controller 156 is supplied as the synchronous signal from the parent signal stand 111 to the child signal stand 131 by way of the cable 150 at the time of initialization.

The controller 166 in the child signal stand 131 stores the data and the synchronous signal transmitted by the parent signal stand 111 into the RAM, then sets the timer 167 based on the stored data (Step 200). Thereafter the controller 166 reads the present time t from the timer 167 (Step 201).

The controller 166 calculates the time for permitting the green light 136 of the child signal stand 131 based on the present time t and the resultant calculated time into a buffer $\beta$ (Step 202). Then the controller 166 produces and supplies a flashing control signal for permitting the green light 136 to flash first then the red light 135 not to flash (Step 203). The controller 166 reads the actual time t of the timer 167 (Step 204), compares it with the value stored in the buffer $\beta$ (Step 205) and produces and supplies a flashing control signal and repeats the procedure if the actual time t does not coincide with the value stored in the buffer $\beta$ and permits the green light 136 not to flash and the red light 135 to flash if the actual time t coincides with the value stored in the buffer $\beta$ (Step 206).

Thereafter the controller 166 adds $T_1+2T_3$ to the present value of the buffer $\beta$ and stores the resultant value into the buffer (Step 207). The controller 166 reads the actual time t of the timer 167 (Step 208), compares it with the value in the buffer (Step 209) and produces and supplies a flashing control signal and repeats the procedures if the actual time t does not coincide with the value stored in the buffer $\beta$ and permits the green light 136 to flash and the red light 135 not to flash if the actual time t coincides with the value stored in the buffer (Step 210). Successively, the controller 166 adds the setting value $T_2$ to the value of the buffer $\beta$ and stores the resultant value in the buffer $\beta$ (Step 211). Thereafter, the procedure jumps to Step 204 and Steps 204 to 211 are repeated during the operation setting period.

Although the flashing times $T_1$1 to $T_3$ are decided based on the actual time of the timers 157 and 167, theses times are subject to delay to some extent. However, inasmuch as the time correction signal is supplied every hour from the time correction circuit 161 to the controller 166 to correct the time, there does not occur the case where the red lights 115 and 135 and green lights 116 and 136 flash in a different way.

As mentioned above, inasmuch as the starting operations of both the parent and child signal stands are effected based on the starting time $t_0$, the synchronization of the flashing operations between the red lights 115 and 135 and the green lights 116 and 136 is effected by the timers 157 and 167 for supplying the actual times and the time correction circuits 161 and 171 for correcting the timers 157 and 167, and thus a synchronous cable for connecting both the parent and child signal stands is unnecessary, thereby facilitating the handling of the system.

Figure 20:
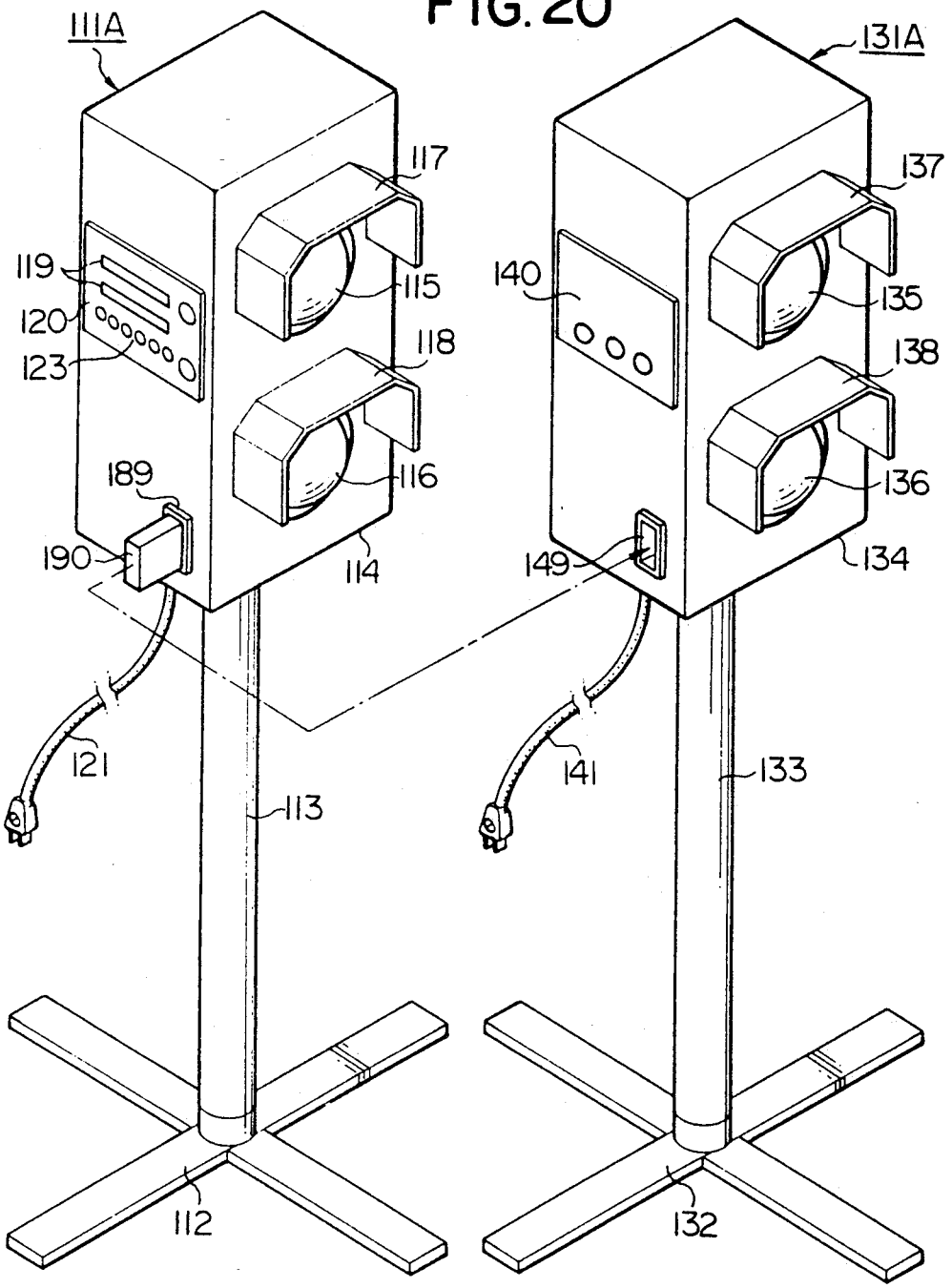
FIG. 20 is a perspective view showing parent and child signal stands, of a temporary signal system according to the eighth embodiment of the invention.
Figure 21A:
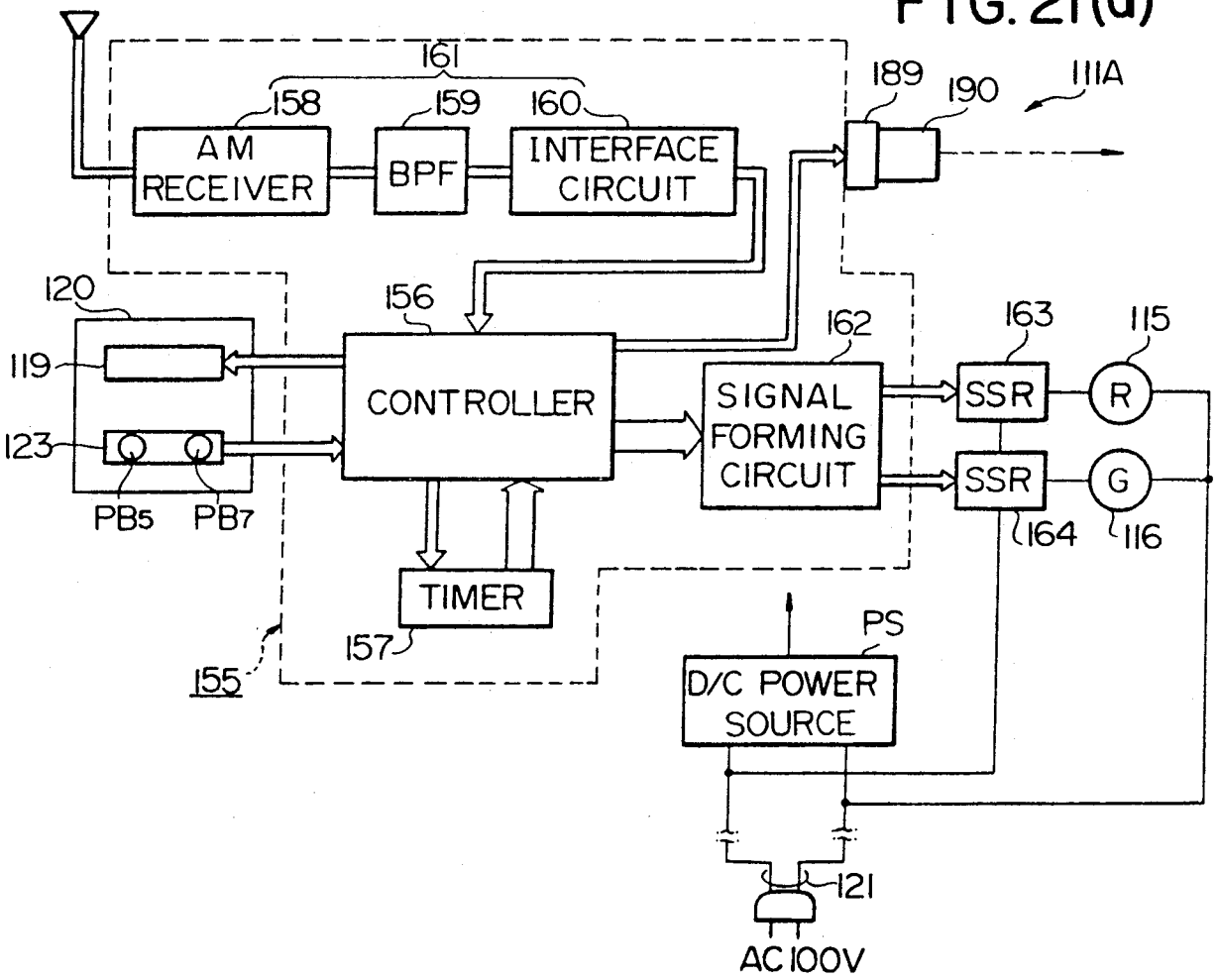
FIG. 21(*a*) is a circuit diagram of the parent signal stand and FIG. 21(*b*) is a circuit diagram of the child signal stand of FIG. 20.
Figure 21B:
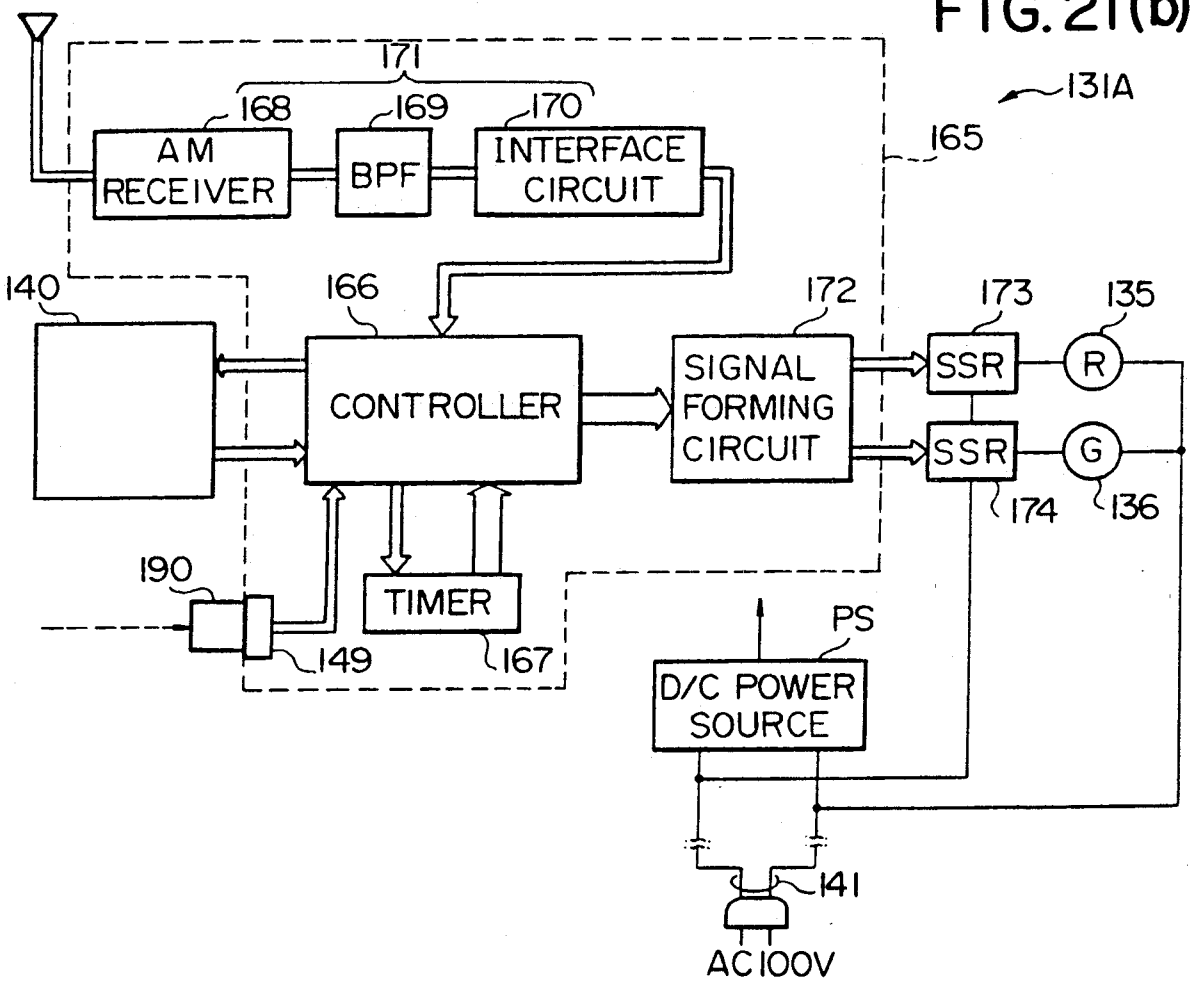

Eighth Embodiment (FIGS. 20 and 21(*a*) and 21(*b*))

A temporary signal system according to an eighth embodiment will be described with reference to FIGS. 20, 21(*a*) and 21(*b*).

According to the eighth embodiment, the setting data set in the parent signal stand 111A is stored in an integrated circuit (IC) card (signal transmission means) 190 which is connected to the child signal stand 131A for supplying the data stored therein to the child signal stand 131A.

That is, the temporary signal system of the eighth embodiment comprises the parent signal stand 111A, the child signal stand 131A, the setting data set in the parent signal stand 111A and the IC card 190 for supplying the synchronous signal to the child signal stand 131A. The parent signal stand 111A has an IC Card socket 189 at the side surface of the operation board 120 to which socket 189 the IC card 190 can be detachably attached.

The child signal stand 131A also has an IC card socket 149 at the side surface of the operation board 140 to which socket the IC card 190 can be detachably attached.

As illustrated in FIG. 21(*a*), the IC card socket 189 is connected to the controller 156. If the push button PB7 of the operation portion 123 is pressed, both the setting data and the synchronous signal can be supplied to the IC card 190 connected to the socket 189.

Likewise, in FIG. 21(*b*), the controller 166 in the child signal stand 131 receives the setting data and the synchronous signal from the IC card 190 connected to the socket 149 and stores the setting data and the synchronous signal into the RAM. The setting data to be stored in the IC card 190 comprises operation data for operating the child signal stand 131A according to the specific time interval, a flashing time $T_1$ of the green light 116 of the parent signal stand 111A, a flashing time $T_2$ of the green light 136 of the child signal stand 131A and an overlap time $T_3$ of both the red lights 115 and 135 of both the parent and child signal stands 111A and 131A.

The first time $t_0$ based on which the parent signal stand 111A is operated is used as the synchronous signal to be stored in the IC card 190. The arrangement of the eighth embodiment is substantially the same as the seventh embodiment excepting the components set forth above.

Both the parent and child signal stands 111A and 131A are respectively installed at the exit and entrance 182, 183 of the construction site 181 in the same manner as the seventh embodiment. Then, the operation condition of the parent signal stand 111A is initialized and the initialized data is stored in the RAM and the start button PB5 is pressed. As a result, the controller 156 starts its operation. Thereafter, the IC card 190 is connected to the IC card socket 189 of the parent signal stand 111A and the push button PB5 of the operation board 120 is pressed, whereby the setting data set in the RAM of the controller 156 and the synchronous signal are stored in the IC card 190.

The IC card is carried to the child signal stand 131A and plugged into the socket 149 of the child signal stand 131A so that the setting data and the synchronous signal are transferred in the RAM of the controller 166. Thereafter, the controller 166 of the child signal stand 131A starts its operation, thereby setting the timer 167 based on the setting data stored in the RAM of the controller 166 and providing synchronization with the parent signal stand 111A on the basis of the actual time from the timer 167 and the synchronous signal. Since the time of the timer 167 is corrected every hour based on the correction signal issued by the time correction circuit 171, the child signal stand 131A is always synchronous with the parent signal stand 111A.

According to the eighth embodiment, since the setting data of the operation condition and the synchronous signal are stored in the IC card 190 and supplied from the parent signal stand 111A to the child signal stand 131A, both the parent and child signal stands can be synchronized with each other even if they are remotely located form each other. Furthermore, it is possible to vary the setting data freely since the operation condition need not be set at the same place. The other functions and advantages are the same as the seventh embodiments.

According to the seventh and eighth embodiments, the flashing operations between the red lights and the green lights can be synchronous with each other since the setting data of the operation condition can be supplied from the parent signal stand to the child signal stand or vice versa.

Although the setting data of the operation condition can be transmitted between both signal stands by the short cable 150 or the IC card 190 or the like, they can be transmitted, e.g. by a recording media such as a tape, a floppy disk or the like.

As mentioned above, since the setting data and the synchronous data can be supplied from one signal stand to the other signal stand by means of the signal transmission means, it is possible to coincide the actual time of one signal stand with that of the other signal stand and synchronize the flashing operations of the signal lights by the actual time, the setting data and the synchronous data. As a result, a permanent cable for connecting both signal stands can be eliminated and there is no worry about breakage of the cable. Still furthermore, the synchronous cable is not required which facilitates handling of the temporary signal system.

Although the invention has been described in its preferred form with a certain degree of particularity, it is to be understood that many variations and changes are possible in the invention without departing from the scope thereof.

What is claimed is:

1. A temporary signal system comprising:

two signal stands installed at spaced locations adjacent a traffic restriction area and each having at least red and green lights which light for predetermined time periods so as to control vehicle traffic passing the traffic restriction area, each of said two signal stands including:

(a) timer means for counting actual time and providing a time signal indicative of the actual time, (b) controller means operable in response to the time signal for producing lighting control signals for controlling operation of said red and green lights in sequence, and (c) lighting driving means responsive to lighting control signals from said controller means for causing said red and green lights to light or extinguish in sequence;

separate operation starting mans in each of said two signal stands and connected to said controller means thereof for separately initiating operation of said controller means of both of said signal stands at the same time, there being no control cable connecting said two signal stands to each other; and time correction means connected to each said controller means for periodically and simultaneously supplying correction signals to said controller means of said two signal stands so that said controller means of said tow signal stands operate in timed synchronism with each other, each said time correction means comprising a radio receiver for receiving a time signal from a broadcast station.

2. A temporary signal system according to claim 1 in which said controller means is a microcomputer central processing unit connected to said timer means and said time correction means for receiving separate inputs therefrom, an operation board comprising separate control elements for individually setting the time periods during which (1) both said red lights are "on" and both said green lights are "off", (2) said green light of one signal stand is "on", said red light of said one signal stand is "off", said red light of the other signal stand is "on" and said green light of said other signal stand is "off", and (3) a condition of the lights in (2) is reversed, said operation board having an output connected to said microcomputer central processing unit for causing same to generate lighting control signals for said time periods, said operation starting means in each signal stand being a switch on said operation board thereof.

3. A temporary signal system according to claim 1, wherein said operation starting means includes an activating switch provided at each signal stand with the activating switches of both signal stands being substantially simultaneously actuated.

4. A temporary signal system according to claim 3, wherein said activating switches comprise manually-actuatable push button switches.

5. A temporary signal system according to claim 1, wherein the operation starting means includes cableless signal means having a part provided at each signal stand for transmitting a start control signal between the signal stands.

6. A temporary signal system according to claim 5, wherein the signal means includes a signal transmitter provided at one said stand and a signal receiver provided at the other said stand.

7. A temporary signal system according to claim 6, wherein the signal means utilizes a radio wave as the start control signal.

8. A temporary signal system according to claim 6, wherein the signal means utilizes a light wave as the start control signal.

9. A temporary signal system according to claim 6, wherein the signal means utilizes a laser beam as the start control signal.

10. A temporary signal system according to claim 6, wherein the signal means utilizes a sound wave as the start control signal.

11. A temporary signal system comprising: first and second signal stands installed at spaced locations adjacent a traffic restriction area and each having red and green lights which light for predetermined time periods to control vehicle traffic passing the traffic restriction area, said first and second signal stands each having a controller operable to produce lighting control signals for controlling operation of said red and green lights in sequence, said controllers each containing memory means for storing commands for operating said controllers to produce said lighting control signals and for synchronizing operation of the lights of said first and second signal stands, said first and second signal stands each having lighting driving means responsive to lighting control signals from said controller of its associated signal stand for causing said red and green lights to light or extinguish in sequence;

timers connected to said controllers of said first and second signal stands for counting actual time and providing input signals to said controllers of said first and second signal stands, which input signals are indicative of the actual time so that said lighting control signals are based on said actual times provided by said timers;

an operation starting means connected to said controller of said first signal stand; initializing means operatively connecting said controller of said first signal stand to said controller of said second signal stand for transferring said commands from said memory means of said controller for said first signal stand and storing same in said memory means of said controller for said second signal stand so that both controllers produce the lighting operation signals synchronously.

12. A temporary signal system according to claim 11, wherein the initializing means comprises a disconnectable cable for temporarily connecting both of the stands.

13. A temporary signal system according to claim 11, wherein the initializing means comprises an external device capable of movement between and connection to each of the stands.

14. A temporary signal system according to claim 13, wherein the external device comprises an IC card device which can be separately coupled to each said stand.

15. A temporary signal system according to claim 13, wherein the external device comprises a portable memory device which can be separately coupled to each said stand.

16. A temporary signal system as claimed in claim 11, including separate time correction means connected to said controllers of said two signal stands, respectively, for periodically and simultaneously supplying correction signals to said controllers of said two signal stands so that said controller means of said two signal stands operate in timed synchronism with each other, said time correction means comprising a radio receiver for receiving a time signal from a broadcast station.

17. A temporary signal system as claimed in claim 16 in which each of said controllers for said two signal stands is a microcomputer central processing unit connected to said timer and said time correction means for receiving inputs therefrom, said first signal stand having an operation board comprising separate control elements for individually setting the time periods during which (1) both said red lights are "on" and both said green lights are "off", (2) said green light of one signal stand is "on", said red light of said one signal stand is "off", said red light of the other signal stand is "on" and said green light of said other signal stand is "off", and (3) a condition of the lights in (2) reversed, said operation board having an output connected to said microcomputer central processing unit of said first signal unit for causing same to generate lighting control signals for said time periods, said operation starting means of said first signal stand being a switch on the operation board thereof.

18. A temporary signal system, comprising: first and second signal stands installed at spaced locations adjacent a traffic restriction area and each having red and green lights which light for predetermined time periods to control vehicle traffic passing the traffic restriction area, said first and second signal stands each having a controller operable to produce lighting control signals for controlling operation of said red and green lights in sequence, said first and second signal stands each having lighting driving means responsive to lighting control signals from said controller of its associated signal stand for causing said red and green lights to light or extinguish in sequence;

a timer connected to said controllers of said first signal stand for counting actual time and providing input signal to said controller of said first signal stand, which input signal is indicative of the actual time, said controller of said second signal stand being free of connection to a timer;

an operation starting means connected to said controller of said first signal stand;

a cableless signal means operatively connecting said controller of said first signal stand to said controller of said second signal stand, said cableless signal means comprising a transmitter in said first signal stand and connected to receive an output from said controller thereof and convert same into a signal, and a signal receiver on said second signal stand and connected to receive said signal from said transmitter and supply said signal to said controller of said second signal stand, said controller of said first signal stand being a microcomputer central processing unit connected to said timer for receiving an input therefrom, an operation board comprising separate control elements for individually setting the time periods during which (1) both said red lights are "on" and both said green lights are "off", (2) said green light of one signal stand is "on", said red light of said one signal stand is "off", said red light of the other signal stand is "on" and said green light of said other signal stand is "off", and (3) a condition of the lights in (2) reversed, said operation board having an output connected to said microcomputer central processing unit for causing said to generating lighting control signals for said time periods, said operation starting means in said first signal stand being a switch on the operation board thereof, said second signal unit being free of an operation board and the operation of said second signal unit be completely under the control of the operation of said microprocessor central processing unit of said first signal stand.

19. A temporary signal system as claimed in claim 18, including time correction means connected to said controller of said first signal stand for periodically and simultaneously supplying a correction signal to said controller of said first signal stand, said time correction means comprising a radio for receiving a time signal from a broadcast station.

* * * * *

UNITED STATES PATENT AND TRADEMARK OFFICE

CERTIFICATE OF CORRECTION

PATENT NO. : 5 252 969

DATED : October 12, 1993

INVENTOR(S) : Mitsuhiro Kishi

It is certified that error appears in the above-identified patent and that said Letters Patent is hereby corrected as shown below:

Column 17, line 26; change "mans" to ---means---.
line 37; change "tow" to ---two---.
line 41; change "according to" to ---as claimed in---.

Column 18, line 19; after "system" insert ---,---.

Column 19, line 22; after "(2)" insert ---is---.
line 42; change "controllers" to ---controller---.
line 43; after "providing" insert ---an---.

Column 20, line 26; after "(2)" insert ---is---.
line 29; change "said to generating" to ---same to generate---.
line 31; change "the" to ---said---.

Signed and Sealed this

Nineteenth Day of April, 1994

Bruce Lehman

*Attest:*

BRUCE LEHMAN

*Attesting Officer*

*Commissioner of Patents and Trademarks*